United States Patent [19]

Stohlquist et al.

[11] Patent Number: 4,545,183

[45] Date of Patent: Oct. 8, 1985

[54] PACKAGING MACHINE

[75] Inventors: Roger H. Stohlquist, Rockford, Ill.; Roger A. Stenberg, Beloit, Wis.

[73] Assignee: APV Anderson Bros. Inc., Rockford, Ill.

[21] Appl. No.: 662,706

[22] Filed: Oct. 19, 1984

Related U.S. Application Data

[63] Continuation-in-part of Ser. No. 604,984, Apr. 27, 1984, abandoned.

[51] Int. Cl.[4] ..... B65B 43/24

[52] U.S. Cl. ..... 53/566; 53/374

[58] Field of Search ..... 53/249, 250, 252, 374, 53/375, 382, 383, 564, 566; 198/772, 773; 493/183, 453

[56] References Cited

U.S. PATENT DOCUMENTS

| | | | |
|---|---|---|---|
| 1,468,333 | 9/1923 | Thom | 53/374 |
| 2,770,935 | 11/1956 | Nigrelli | 53/566 |
| 2,931,524 | 4/1960 | Hallenius | 198/772 |
| 3,298,287 | 1/1967 | Peterson et al. . | |
| 3,412,652 | 11/1968 | McIntyre | 53/566 |
| 3,418,893 | 12/1968 | Stohlquist et al. . | |
| 3,420,037 | 1/1969 | Villemure et al. | 53/566 |
| 3,698,542 | 10/1972 | Reger et al. | 198/772 |

*Primary Examiner*—John Sipos

*Assistant Examiner*—Donald R. Studebaker

*Attorney, Agent, or Firm*—Vernon J. Pillote

[57] ABSTRACT

A packaging apparatus for feeding, erecting, loading and closing cartons. The packaging apparatus comprises a generally vertically extending carton transfer mechanism for advancing cartons upwardly in step fashion from a carton infeed station adjacent the lower end of the carton transfer mechanism past a carton loading station and to a carton discharge station at the upper end of the carton transfer mechanism. A carton transfer mechanism that includes laterally spaced carton guides that are open at the front and rear sides and transfer slides that are reciprocable along the carton guides. A carton magazine supports a stack of cartons adjacent the open front side of the carton guides and a carton infeed mechanism is mounted for movement in a plane parallel to and between the guides to withdraw cartons from the end of the stack and feed the cartons with open end leading into a position between the guides. A flap folding mechanism infolds the end flaps on the cartons and holds the cartons against upward movement during upward folding of the side flaps on the ends of the carton. Adhesive is applied in a horizontal band crosswise of the path of movement of the cartons and the side flap on the upper panel of the carton is then folded downwardly to close and seal the carton.

36 Claims, 29 Drawing Figures

Fig. 12.
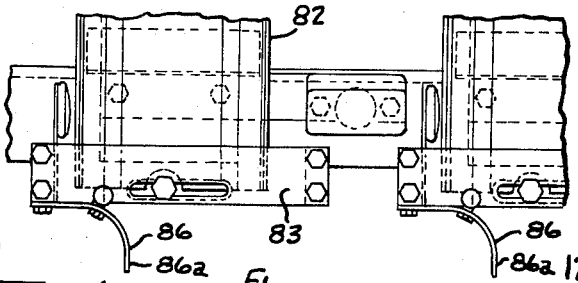
Fig. 11.
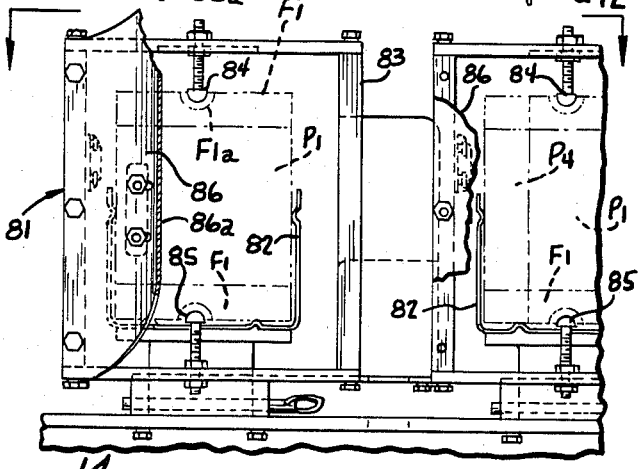
Fig. 14.
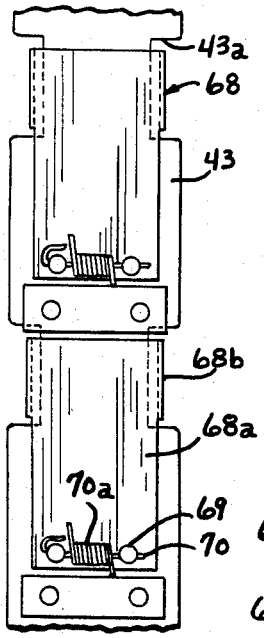
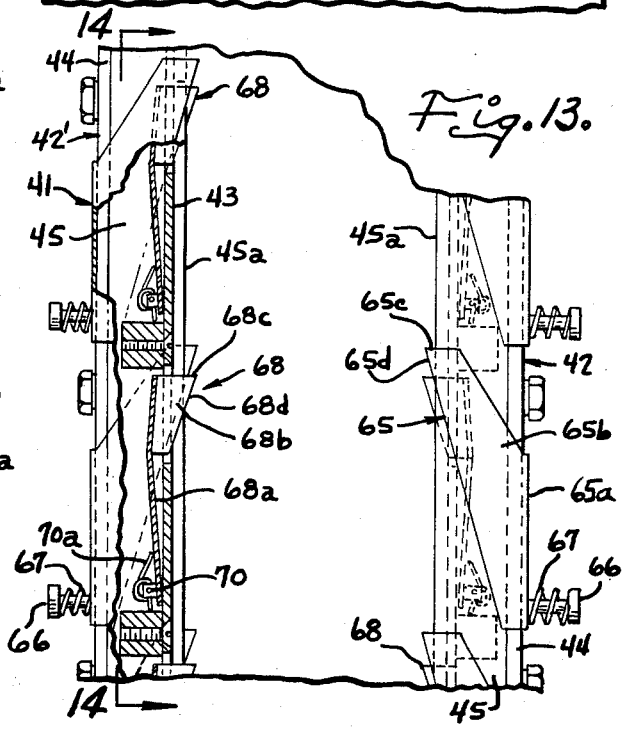
Fig. 13.

18
255"
143"
262"
261"
253a"
253"
273"
146"
251"
258"
257"
137"
41"
136a
141"
252d
134a"
139a"
138a"
134c"
134b"
134d"
139b"
138b"
19
161
131"
43"
45"
43a"
252"
277"
146"
254"
254a"
264"
265"
143
255"
23
261"
262"
253a"
251"
271"
272"
135a"
136a"
139b"
138a"
136b"
135b"
138b"
134a
134c"
134d"
134b"
134m"
275"
274"
276"
24

Fig. 20.
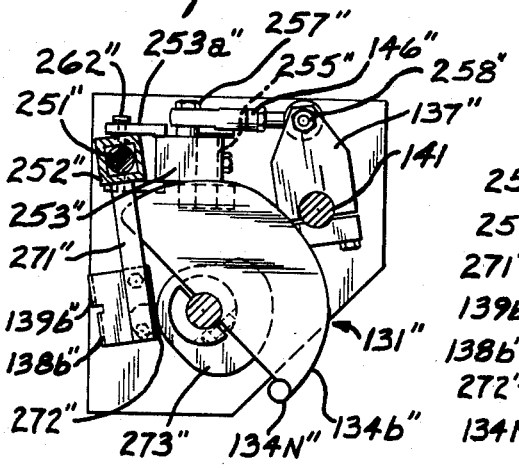
Fig. 19.
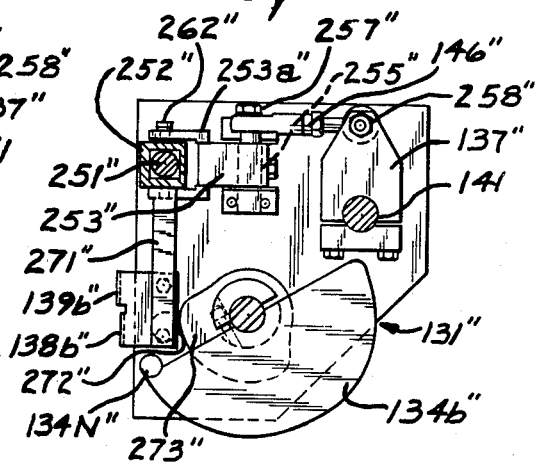
Fig. 21.
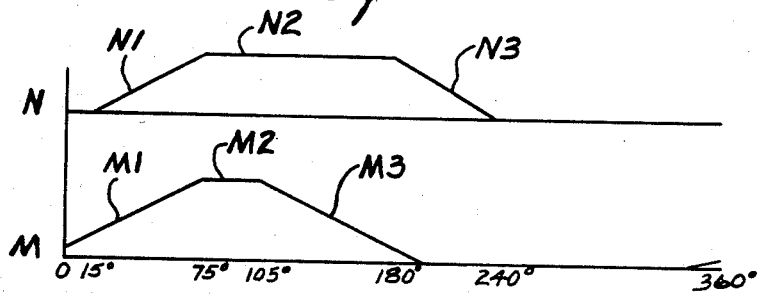
Fig. 22.
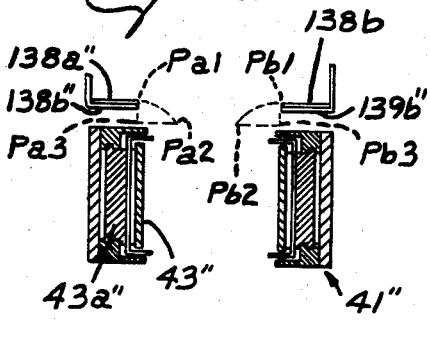
Fig. 23.
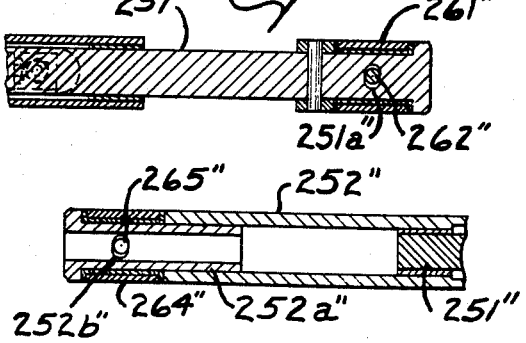
Fig. 24.

PACKAGING MACHINE

CROSS-REFERENCE TO RELATED APPLICATION

This application is a continuation-in-part of application Ser. No. 06/604,984, filed Apr. 27, 1984, now abandoned.

BACKGROUND OF THE INVENTION

Various different packaging machines have heretofore been made for erecting flattened cartons, loading the cartons with product and closing and sealing the end flaps on the cartons. The prior packaging machines generally used a horizontally extending conveyor or transfer mechanism for advancing cartons in a single lane along a horizontal path from a carton infeed station and past the loading station and flap folding stations to a discharge station. For example, some packaging machines such as shown in U.S. Pat. No. 3,418,893 utilize a reciprocating transfer mechanism to advance cartons along a horizontal path with the cartons in an upright position for loading through the top. Some others such as shown in U.S. Pat. No. 3,298,287 utilize endless type conveyors and advance cartons in a horzontal position along a horizontal path for loading from the side of the conveyor. Such horizontal packaging machines require a large amount of floor space. Further, the output of single lane machines is limited by the speed at which the packaging machine can be cycled and packaging machines having horizontal conveyors are not well adapted for arrangement in multiple side-by-side lanes to increase the total capacity of the packaging machine. It would be difficult for an operator to reach to the center lanes of a horizontal multi-lane machine. Further, problems would be encountered in the loading of product into the center lanes of a multiple lane packaging machine, particularly if the conveyor is of the type that advances the cartons in a horizontal position for loading from the side of the conveyor.

SUMMARY OF THE INVENTION

It is an object of the present invention to provide a packaging machine which erects, loads, closes and seals cartons, and which requires only a small floor space.

Another object of this invention is to provide a multi-lane packaging machine for erecting, loading, closing and sealing cartons, which requires a small floor space and which provides easy operator access to even the center lanes of a multi-lane machine.

Another object of this invention is to provide a multi-lane packaging machine which can be cycled at high speeds.

The packaging machine of the present invention is arranged to feed, load and close cartons of the type having a pair of side panels hingedly interconnected to a pair of end panels and side and end flaps on opposite ends of the side and end panels. The packaging machine comprises an upright carton transfer means extending from a carton infeed station adjacent its lower end past the carton loading station to a carton discharge station adjacent the upper end of the carton transfer means. The carton transfer means includes a pair of generally vertically extending lateral carton guides defining parallel carton guide planes and the carton transfer means is open along its front and rear sides between the guide planes. The carton transfer means includes a plurality of carton supports at spaced locations along the lateral carton guides each adapted to underlie and support a carton after it is advanced therepast, and a transfer slide mounted for reciprocation along each carton guide and having a plurality of pushers at spaced locations along the slides operative when the slide is moved upwardly to advance a plurality of cartons upwardly in step fashion. A carton magazine stores a stack of flattened carton blanks adjacent the carton infeed station and a carton infeed means withdraws a flattened carton blank from one end of the stack and erects and feeds the erected carton to the carton guides with the end panels of the carton disposed alongside the carton guides and the side panels extending horizontally between the guides and with the side and end flaps extending through the open front and rear sides of the carton transfer means. Drive means reciprocates the transfer slides and operates the carton infeed means in timed relation with the reciprocating of the transfer slides. Carton loading means feeds product along a generally horizontal path into the carton at the loading station, and means intermediate the upper and lower ends of the carton transfer means infolds the side and end flaps on the cartons. A carton receiving means is located adjacent the upper ends of the carton guides and a carton discharge means adjacent the upper end of the carton guides discharges cartons from the carton guides onto the receiving means.

The packaging apparatus preferably includes a plurality of upright carton transfer means disposed in side-by-side relation to provide a multiple lane machine for high volume output. The carton magazines are advantageously located at the front side of the carton transfer means and the carton infeed means is mounted for movement in a plane intermediate and parallel to the carton guide planes to withdraw a carton from the magazine and feed it to a position between the lateral carton guides with the carton end panels disposed alongside the carton guides and the side panels extending horizontally between the guides and with the side and end flaps extending through the open front and rear sides of the carton transfer means.

Another aspect of the present invention relates to an improved apparatus for infolding the end and side flaps on the cartons. The flap folding mechanism includes a pair of end flap folding fingers mounted for movement toward and away from each other, and which are arranged to engage and infold the end flaps on a respective end of the carton when the arms are moved toward each other to an end flap folding position. A side flap folding cam is mounted for movement through a flap folding cycle to engage and fold one of the side flaps on one end of the side panels across the end of the carton while the end flap folding fingers are in their end flap folding position, and the end flap folding fingers are thereafter moved away from each other and out of a position between the respective end flap and the infolded side flap.

BRIEF DESCRIPTION OF THE DRAWINGS

FIG. 11 is a fragmentary sectional view taken on the plane 11—11 of FIG. 8 and illustrating the end face of the carton magazine;

FIG. 12 is a fragmentary sectional view taken on the plane 12—12 of FIG. 11 and illustrating a portion of the end of the carton magazine;

FIG. 13 is a fragmentary view of a portion of a carton transfer means with parts broken away and shown in section to illustrate details of construction;

FIG. 14 is a fragmentary view of a portion of a carton transfer slide taken on the plane 14—14 of FIG. 13;

FIG. 19 is a fragmentary transverse sectional view taken on the plane 19—19 of FIG. 17;

FIG. 20 is a fragmentary transverse sectional view taken on the plane 19—19 of FIG. 17 and illustrating the parts in a moved position;

FIG. 21 is a timing diagram illustrating movement of the flap folding mechanism of FIG. 17;

FIG. 22 is a fragmentary transverse sectional view illustrating the path of movement of the flap folding fingers;

FIG. 23 is a fragmentary sectional view on the plane 23—23 of FIG. 18; and

FIG. 24 is a fragmentary sectional view on the plane 24—24 of FIG. 18.

DETAILED DESCRIPTION

Figure 16:
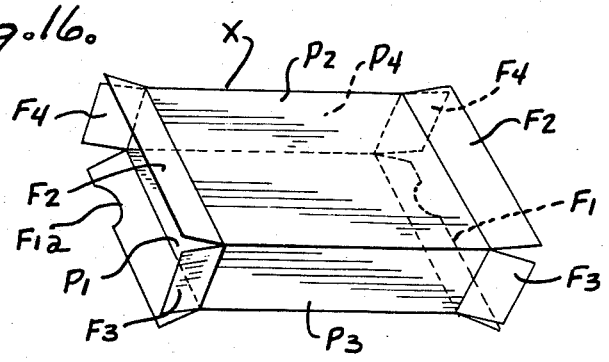
FIG. 16 is a perspective view of an erected carton blank.
Figure 3B:
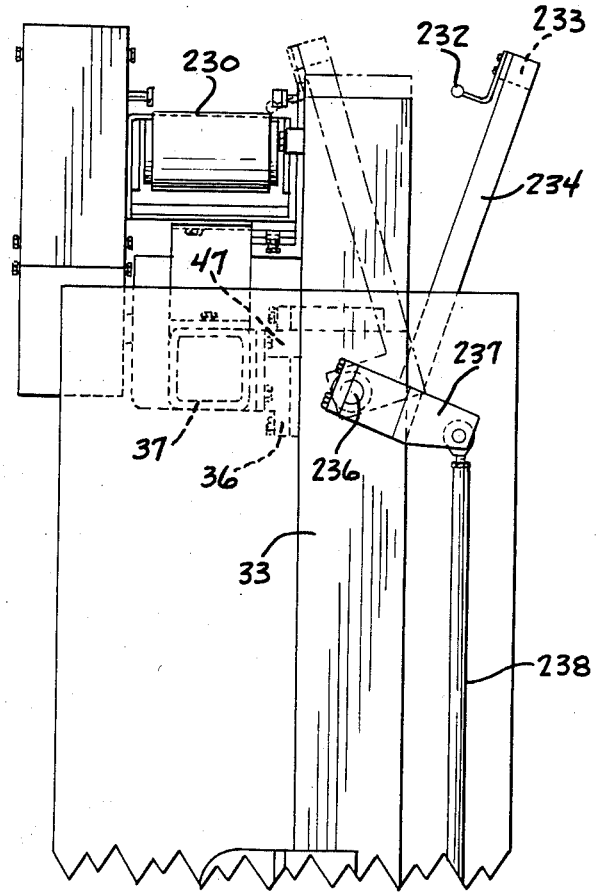

The packaging machine of the present invention is arranged to package product in cartons designated generally by X of the type shown in FIG. 16. In general, the cartons include opposed side panels P1, P2 connected along a fold line to end panels P3 and P4, and side flaps F1 and F2 and end flaps F3 and F4 connected along fold lines to opposite ends of the panels P1-P4 respectively. The cartons are preformed into flattened carton blanks with one side and end panel such as P1 and P4 at one side of the flattened carton blank and the other side and end panels P2 and P3 at the other side of the flattened carton blank. The packaging machine is arranged to feed a flattened carton blank from a magazine, erect the carton, load product into the carton, infold the flaps on the ends of the carton to close the carton and apply adhesive to seal the carton. The packaging machine can package various different products that can be loaded horizontally into cartons and may, for example, be used to package prefilled bags or articles in cartons.

The packaging machine includes a base formed by base frame members 30, 31 and 32, and an upright frame including members 33 and 34. The upright frame members 33 and 34 are secured at their lower ends to the base frame members 30 as by brackets 35 (FIG. 4A), and the upright frame members are interconnected at their upper end by brackets 36 to a cross-frame member 37.

The packaging machine can be provided with a single upright packaging lane, but is preferably formed with a plurality of upright packaging lanes to increase the overall capacity of the packaging machine. In the embodiment illustrated, the packaging machine is provided with two lanes, it being understood that additional lanes can be provided with only a small increase in the overall width of the packaging machine. Each packaging lane includes an upright carton transfer mechanism designated 41 which is arranged to advance cartons from a carton infeed station adjacent its lower end, past a carton loading station and to a carton discharge station adjacent its upper end. The carton transfer mechanisms are of like construction and numerals are used to designate corresponding parts. The carton transfer mechanisms each include a pair of lateral carton guides 42, 42' and transfer slides 43, 43' mounted for reciprocation along the carton guides. As best shown in FIGS. 13, 14, 15A and 15B, the carton guides 42, 42' each include an elongated plate 44 with wayes 45 on the inner side faces of the plate. The wayes extend from the plates 44 toward each other and have carton guide faces 45*a* on the inner edges. The carton guide faces 45*a* on each pair of carton guides 42, 42' are disposed in relatively parallel guide planes and the guides are open at the front and rear sides of the carton guides between the guide planes. The wayes 45 on each of the carton guides 42, 42' have longitudinally extending grooves or recesses 45*b* on their adjacent side faces for slidably receiving the slides 43, 43', respectively.

Figure 10:
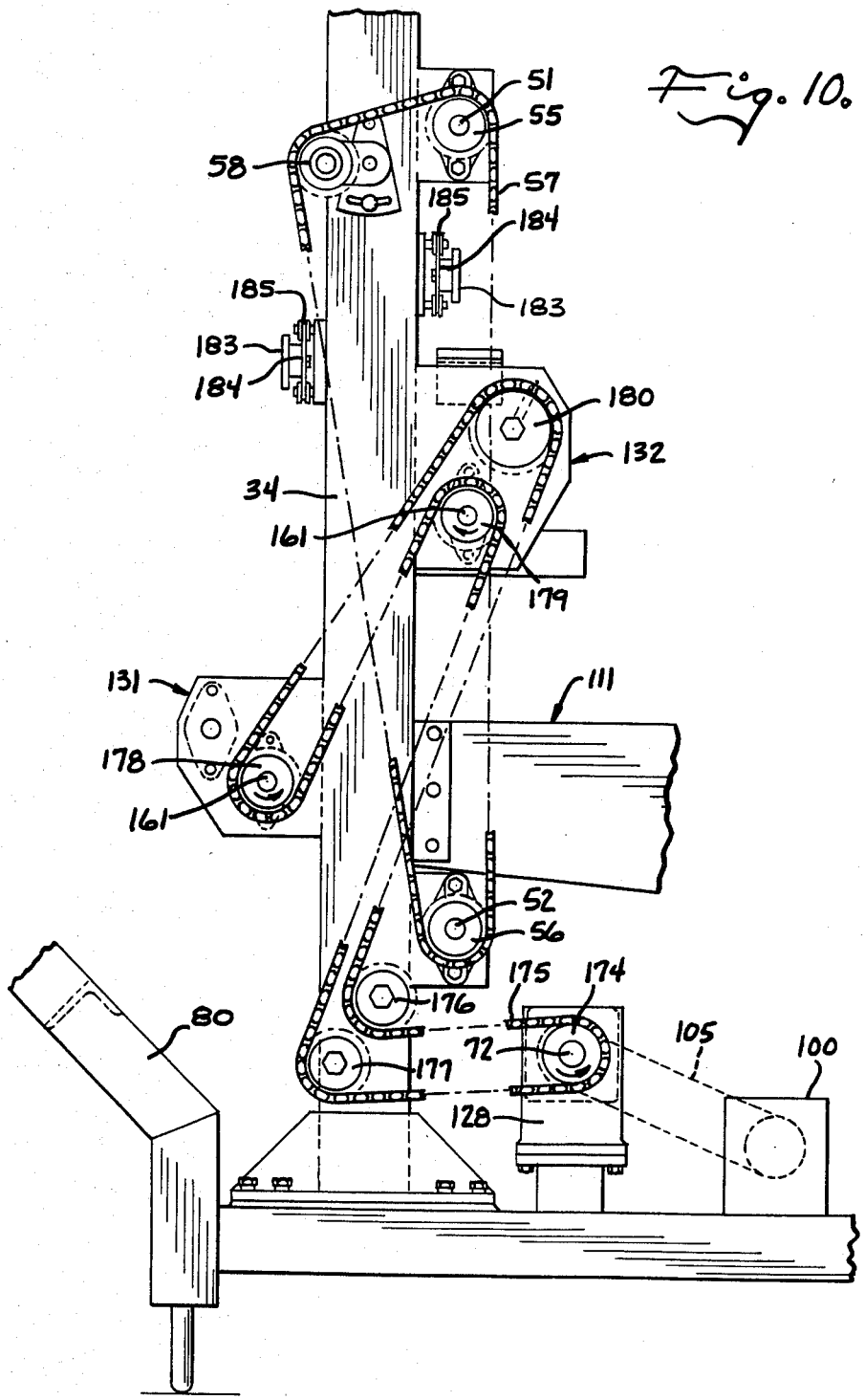
FIG. 10 is a side elevational view taken on the plane 10—10 of FIG. 2.

The guide wayes of each pair are mounted on the frame for adjustment toward and away from each other to accommodate cartons of different width. One of the lateral carton guides 42 of each pair is supported at a fixed location on the frame and, as best shown in FIGS. 4A-4C and 5A-5B, the carton guides 42 are supported at the lower ends on plates 46 secured to base members 31, and at their upper ends by brackets 47 that are secured to the upper cross-frame member 37. The other lateral carton guide 42' of each pair is connected by brackets 48, 49 to upper and lower screw shafts 51 and 52, for adjustment toward and away from the respective lateral carton guide 42. The screw shafts 51 and 52 are rotatably supported by bearings 53 and 54 on the upright frame members 33 and 34 and extend horizontally therebetween. As best shown in FIG. 10, the shafts 51 and 52 have sprockets 55, 56 at one end that are interconnected by a chain 57 that passes over the sprockets and over an adjustable chain tensioning sprocket 58, to cause the shafts 51 and 52 to rotate in unison. An operating wheel 59 (FIG. 4B) is provided on one of the shafts for manually rotating the shafts to effect a course adjustment of the carton guides 42' relative to the respective carton guide 42. In order to enable fine adjustment of the spacing between the guides 42 and 42' of each transfer mechanism independent of the other, the brackets 48, 49 are connected to their respective screw shaft 51, 52 by a worm wheel 61 that is non-slidably and rotatably mounted on brackets 48, 49 for rotation about the axis of the respective screw shaft and which engages the screw thread therein, and which can be rotated by a worm screw (not shown) actuated by a worm screw actuating knob 62. Thus, when the screw shafts 51 and 52 are stationary, the worm screw adjusting knob 61 can be rotated in one direction or the other to make fine adjustments in the spacing between the guide ways 42, 42' on each lane independent of the other lanes.

A plurality of carton supports 65 are provided at uniformly spaced locations along the lateral carton guides 42 and 42' and are each adapted to underlie and support a carton after it is advanced therepast. The carton supports are of similar construction and like numerals are used to designate corresponding parts of each of the carton supports. The carton supports are best shown on a larger scale in FIG. 13 and each include a generally flat web portion 65*a* that overlies the outer face of the respective carton guide 42, 42', and leg portions 65*b* that extend along the front and rear faces of the lateral carton guides and which terminate in nose portions 65*c* that extend inwardly of the carton guide planes to normally underlie and support a carton thereon. The carton supports are attached to the lateral carton guides by pins 66 that loosely extend through openings in the web portions 65*a* of the carton supports, and the carton supports are yieldably urged to their inner carton support position shown in FIGS. 4A–4C and 13 by one or more springs 67. The legs 65*b* have an upwardly and inwardly inclined cam surface 65*d* that extends to the nose 65*c*, and which is arranged to be engaged by a carton as it is advanced therepast to cam the supports outwardly.

The transfer slides 43, 43' are in the form of elongated plates and have a plurality of pushers 68 at uniformly spaced locations therealong that are operative when the slide is moved upwardly to advance a plurality of cartons upwardly in step fashion, and which are operative when the carton is retracted to by-pass the cartons. The carton pushers are best shown on a larger scale in FIGS. 13 and 14. As shown in FIG. 14, the slides 43, 43' have notches 43*a* in opposite side edges at spaced locations therealong and the pushers include a web portion 68*a* disposed at the outer side of the respective slide and leg portions 68*b* that extend through the notches 43*a* to the inner side of the slide. Pins 69 at the rear side of the slide loosely extend through openings in the web portions 68*a* of the pushers and the pushers are retained on the pins by a wire 70. A spring 70*a* disposed on the wire 70, yieldably biases the pushers in a direction to cause the leg portion 68*b* of the pushers to project inwardly of the carton guide plane defined by the associated lateral carton guide. The leg portions 68*b* of the pushers have a nose portion 68*c* at their upper ends adapted to underlie and engage a carton to advance the same when the slide is moved upwardly and the leg portions have a cam surface 68*d* that is inclined upwardly and inwardly to cam the pushers outwardly of the path of the cartons, during retraction of the slides.

Figure 4A:
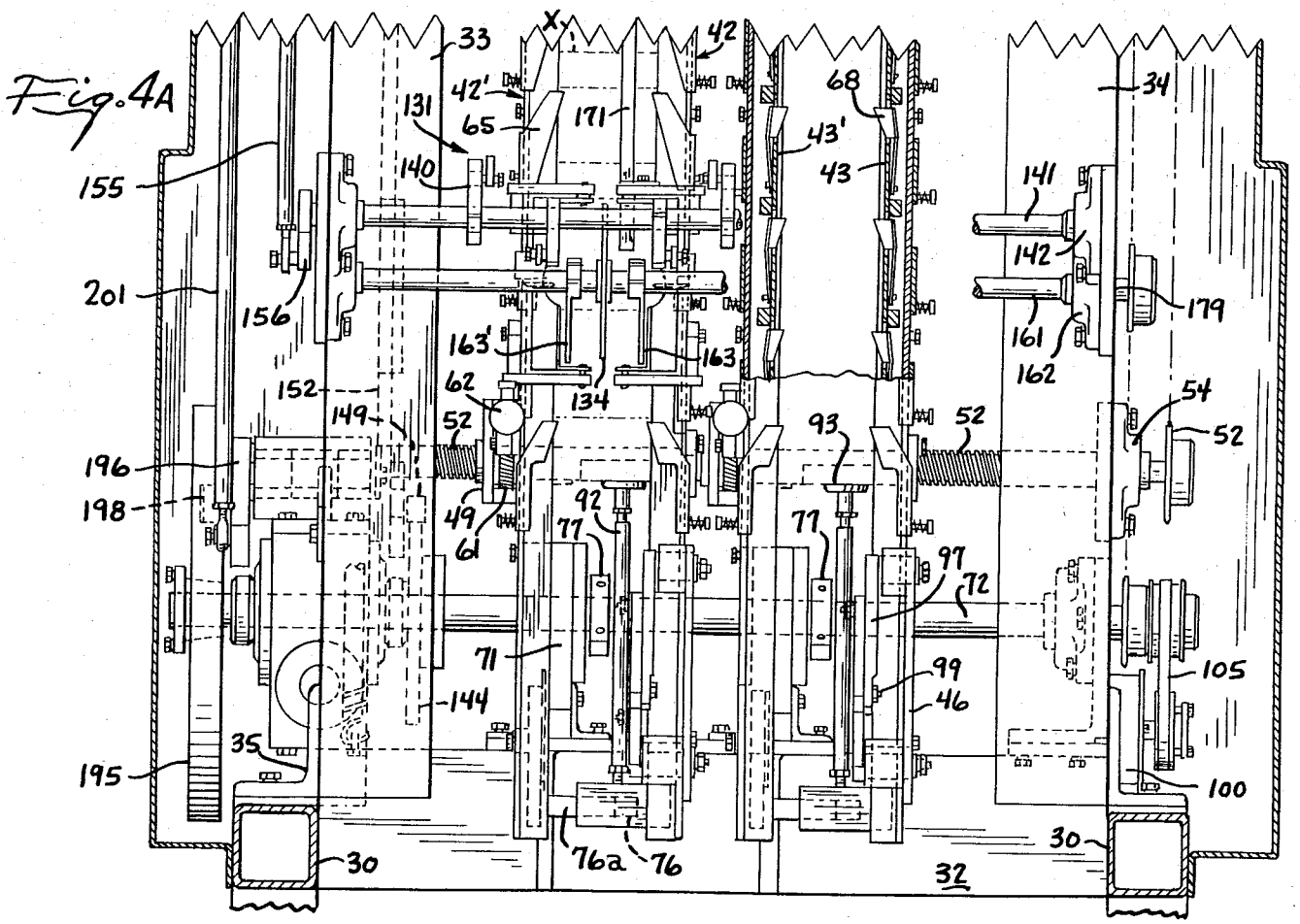
FIGS. 4A, 4B and 4C are different portions of a vertical sectional view taken on the plane 4—4 of FIG. 2.
Figure 4B:
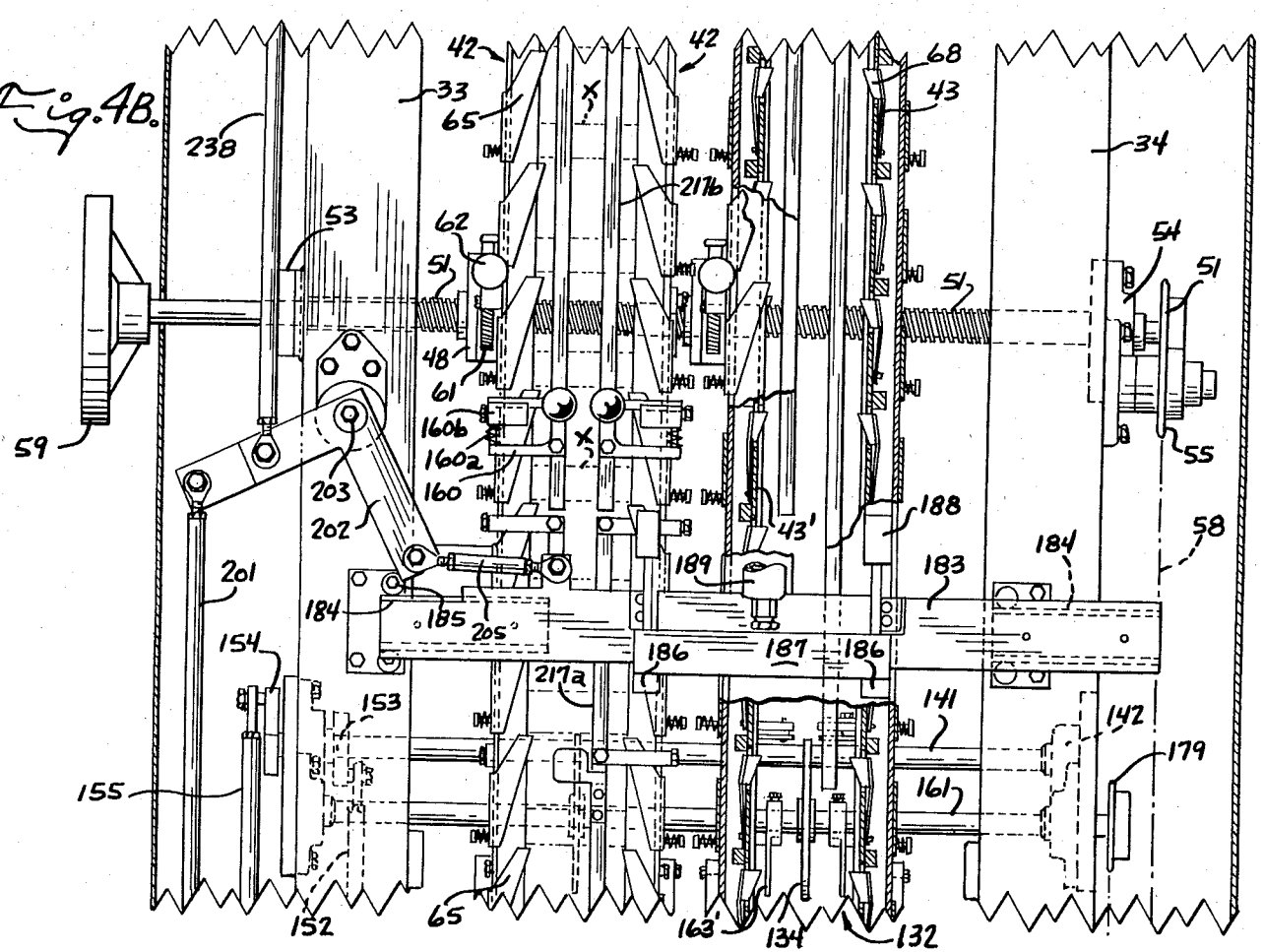
Figure 4C:
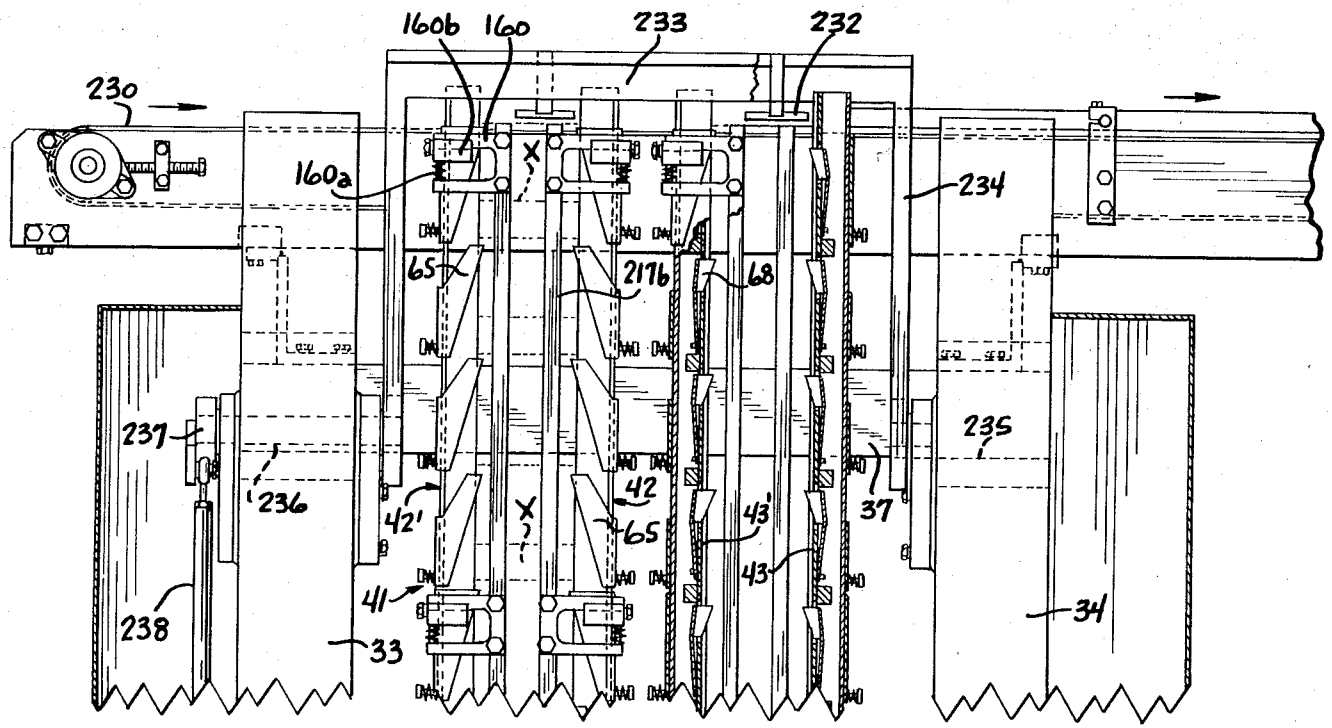
Figure 5A:
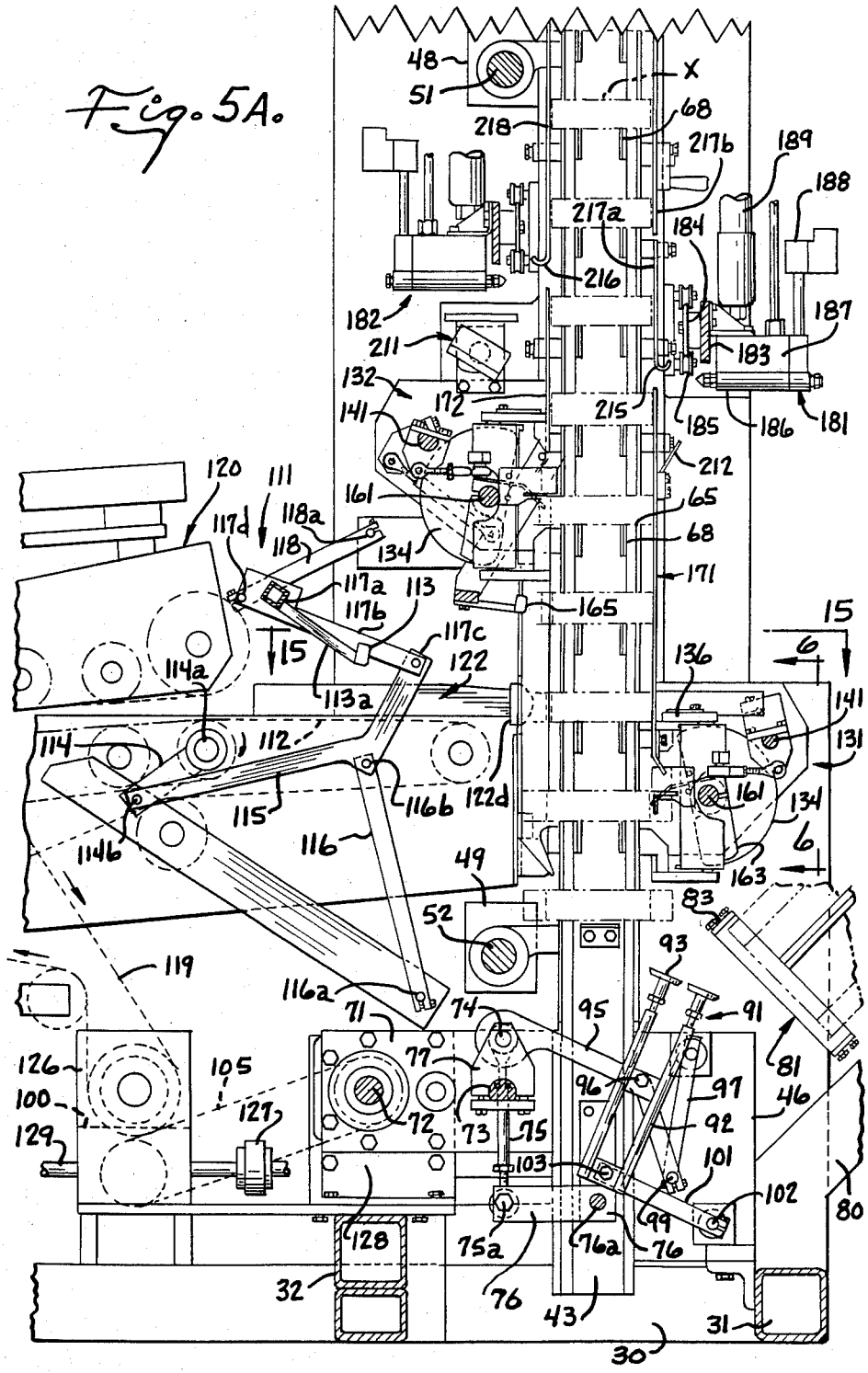
FIGS. 5A and 5B are different portions of a vertical sectional view taken on the plane 5—5 of FIG. 2.
Figure 6:
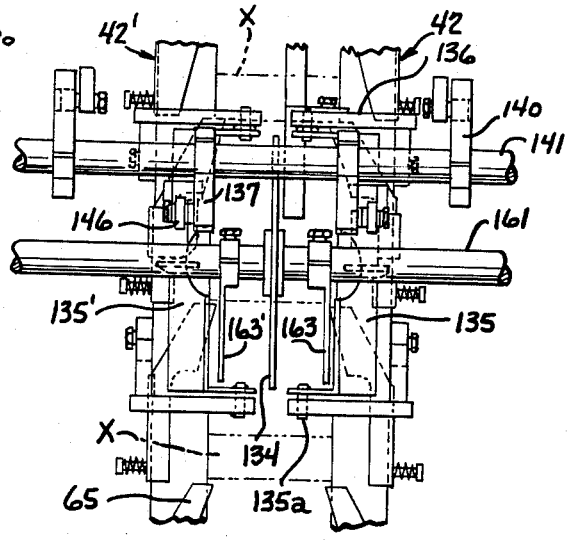
FIG. 6 is a fragmentary vertical sectional view taken on the plane 6—6 of FIG. 5A, and showing the parts on a larger scale than FIG. 5A.
Figure 5B:
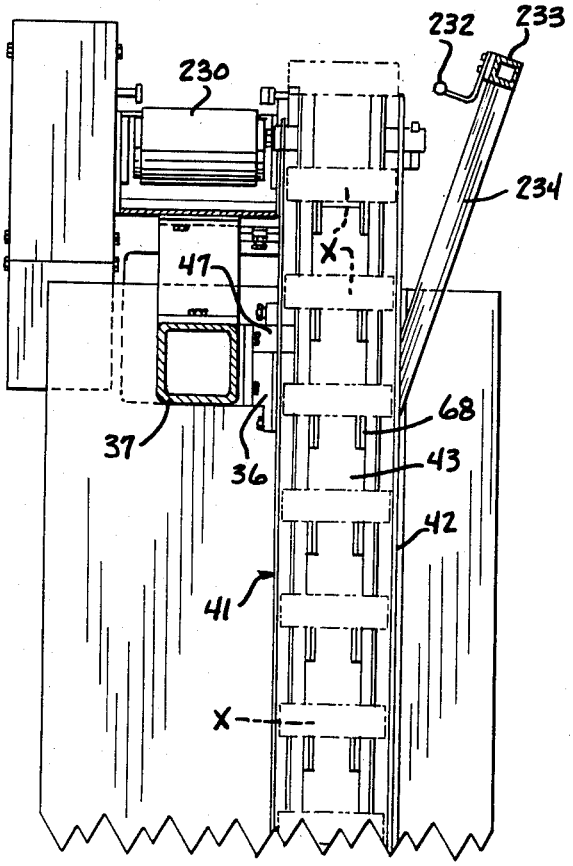

The transfer slides are reciprocated through a distance slightly greater than the spacing between adjacent pushers to advance cartons in step fashion upwardly along the lateral carton guides. As best shown in FIGS. 4A and 5A, a gear box 71 is provided adjacent the lower end of each of the carton transfer means at the rear side thereof and mounted on one of the base frame members 32. A drive shaft 72 extends horizontally through the several gear boxes 71 adjacent their rear side and is drivingly connected through gears (not shown) in the gear box to a crankshaft 73 in each gear box to rotate the crankshaft through one revolution for each revolution of shaft 72. The crankshaft has a crank 77 with an eccentric crank pin 74, and a link 75 is rotatably connected at its upper end to the crank pin and is pivotally connected at its lower end 75*a* to an arm 76 that is rigidly secured to the lower end of one of the transfer slides 43. As shown in FIG. 4A, an arm portion 76*a* on the other of the transfer slides 43' is telescopically receivable in an opening in the arm 76 to effect reciprocation of the slide 43' in unison with the slide 42, while accommodating lateral adjustment between the carton guides. The cranks for the several carton transfer mechanisms are advantageously timed so that the transfer slides of the several transfer means move upwardly and downwardly in unison.

Figure 8:
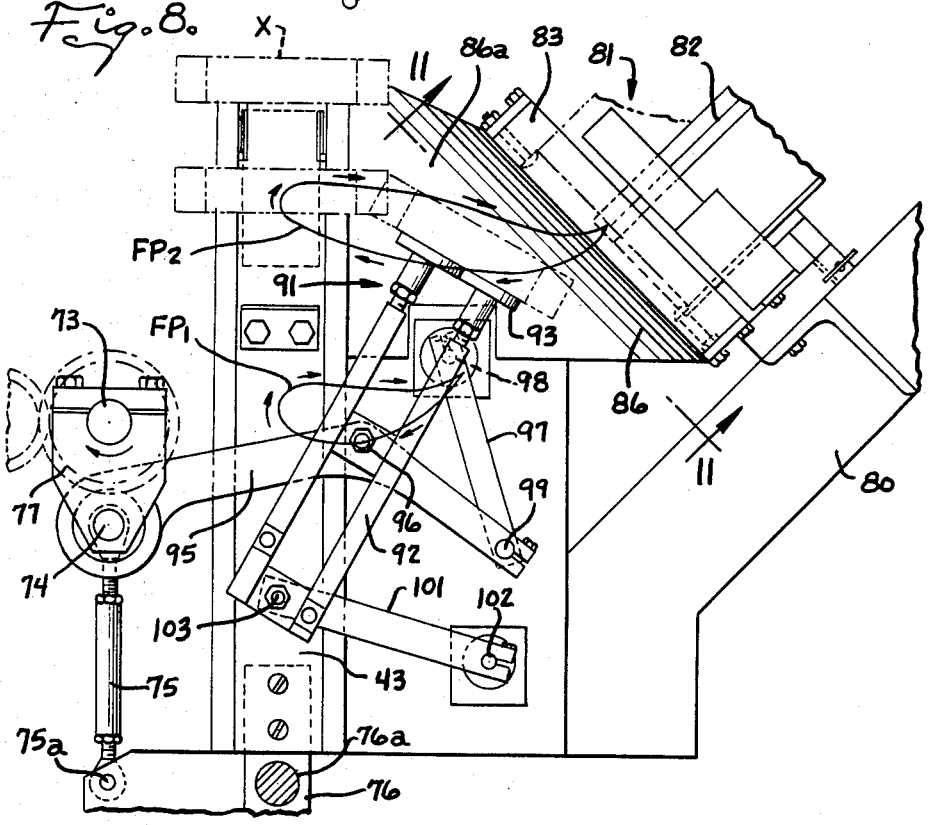
FIG. 8 is a fragmentary vertical sectional view taken in the plane 5—5 of FIG. 2 and illustrating parts in a different position and on a larger scale than FIG. 5.

A plurality of carton magazines 81, one for each transfer means, is provided for supporting a stack of flattened carton blanks at the front side of the respective carton transfer means, at a carton infeed station adjacent its lower end. As best shown in FIGS. 8, 11 and 12 each carton magazine includes a generally U-shaped channel 82 having lengthwise extending bosses at the sides and bottom to guidably engage the stack of carton blanks, when the carton blanks extend perpendicular between the opposite sides of the channel. Different size carton guide channels are provided for cartons of different size. The carton guide channel is mounted as by a bracket 80 on the base frame and the guide channel has a frame 83 at one end disposed in a plane that is inclined downwardly and forwardly relative to the open front side of the respective carton transfer means. The frame has carton stops arranged to engage the end carton in the stack to support the end carton in a plane that is inclined downwardly and forwardly relative to the front side of the respective transfer means and, as best shown in FIGS. 11 and 12, the carton stops are in the form of upper and lower stop pins 84, 85 that extend into the path of movement of the carton blanks in the magazine. The flattened carton blanks are positioned in the stack with the panels P1 and P4 at the end of the stack and the flaps F1 are preferably notched as shown at F1*a* in FIGS. 11 and 16, so that the carton stop pins 84, 85 engage the side flap F2 on the end carton in the stack. A curved carton erecting shoe 86 is mounted on the side of the frame 83 and curves inwardly as best shown in FIG. 12 to engage the panel P4 of the end carton as it is pulled off the stack, to open and square the carton and a guide panel 86*a* extends from the inner edge of the shoe 86 to the respective carton guide 42.

Figure 9:
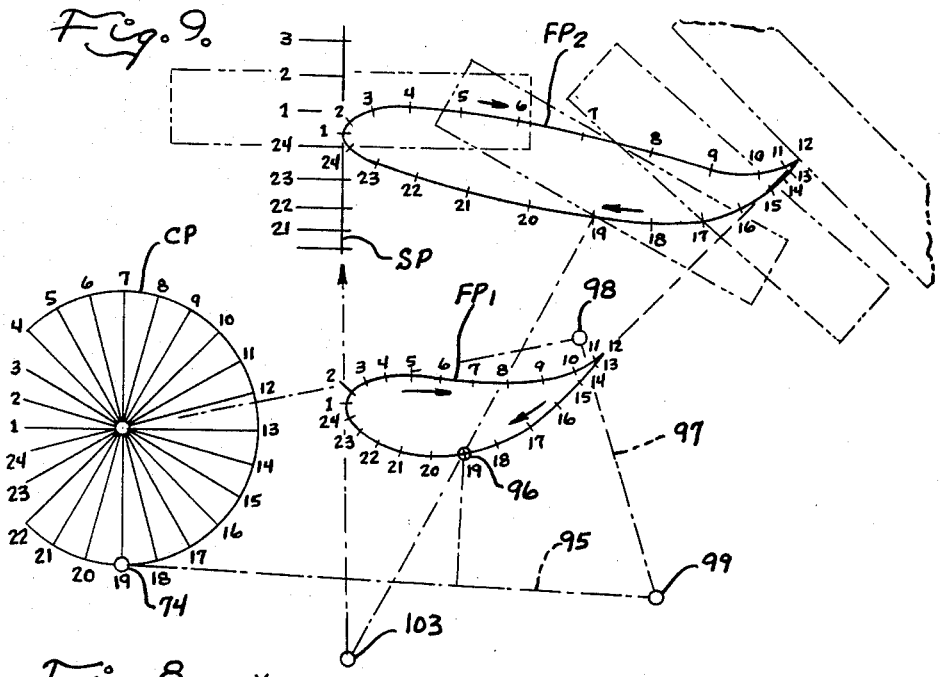
FIG. 9 is a diagrammatic view illustrating movement of the carton infeed mechanism and the transfer mechanism.

A carton infeed mechanism 91 is provided at the carton infeed station for withdrawing a flattened carton blank from one end of the stack in the magazine and for erecting and feeding the erected carton to the lateral carton guides 42, 42' with the end panels of the carton disposed alongside the carton guides and the side panels extending horizontally between the guides and with the side and end flaps extending through the open front and rear sides of the carton transfer means. The carton infeed means includes an elongated feed member 92 that is mounted for oscillation in a plane that extends between and parallel to the carton guide planes of the associated carton transfer means. The feed member 92 has vacuum operated gripper means 93 at its upper end disposed in a plane perpendicular to the plane of oscillation of the feed member. For reasons which will become more apparent from the following description, the feed member is advantageously oscillated by a crank and rocker type four bar type linkage that includes the crank 77, a bar 95 that is rotatably connected at one end to the crank pin 74 and which extends forwardly between the lateral carton guides 42, 42' of the associated transfer mechanism, and a link 97 that is pivotally mounted at its upper end on a fixed pivot 98 and pivotally connected by a pivot 99 at its lower end to the forward end of the bar 95. The bar 95 is pivotally connected intermediate its ends by a pivot 96 to the feed member and a second link 101 is supported on a fixed pivot 102 spaced below the pivot 98 and has its upper end connected by a pivot 103 to the lower end of the feed member 92. The link 97 is somewhat longer than the crank so that the link 97 oscillates or rocks when the crank is rotated. In FIG. 9, the circle CP illustrates the path of movement of the crank pin 74. As the crank rotates clockwise through one revolution from the crank position indicated at 1 in FIG. 9, it moves the bar 95 and link 97 in a manner such that the pivot point 96 passes through a closed loop path designated FP1 in FIGS. 8 and 9, and the vacuum operated grippers 93 at the end of the feed member move through a similar but horizontally enlarged closed loop path designated FP2 in FIGS. 8 and 9. The positions 1–24 on the closed loop paths FP1 and FP2 correspond to the respective angular positions 1–24 of the crank. The transfer slides 43, 43' are reciprocated vertically along a path designated SP in FIG. 9 and the positions 21–24 and 1–3 on the line SP correspond to crank positions 21–24 and 1–3 respectively. When the crank is at angular position 1, the pivot points 96 and 103 on the feed member are disposed substantially in vertical alignment with the lengthwise axis of the carton guides and the vacuum operated grippers are disposed between the guides and substantially perpendicular to the path of advance of cartons on the guides. When the crank is moved to the position indicated at 12 in FIG. 9, the pivot points 96 and 103 of the feed member are disposed along a line substantially perpendicular to the end carton in the magazine and the vacuum operated grippers are disposed generally parallel to the plane of the end carton in the magazine. Thus, the vacuum operated grippers are disposed substantially parallel to and in engagement with the face of the end carton in the magazine at a carton pick-up position indicated at 12 on path FP2. As the grippers are moved away from the carton pick-up position through positions 13–16, the grippers are moved in a direction generally perpendicular to the face of the end carton in the magazine to pull the end carton off the stack and past the carton erecting shoe 86 to open and erect the carton. The vacuum operated grippers then move through positions 17–24 and move the end carton with one open end leading to a position between the lateral carton guides. As the crank moves through positions 23, 24, 1 and 2, it moves the grippers through an upward curve indicated at positions 23, 24, 1 and 2 in the path FP2 and imparts an upward component of movement to the grippers. As the crank moves through positions 23, 24, 1 and 2, it also moves the slide upwardly along path SP through corresponding positions indicated at 23, 24, 1 and 2 on line SP. With this arrangement, the grippers 93 and the slides 43, 43' are both moving in an upward direction as the grippers move through their carton delivery position, to provide a smooth transfer of the cartons from the grippers to the slides. Vacuum is supplied to the gripper under the control of a vacuum control valve (not shown) which is operated in timed relation with the movement of a carton infeed member by a control including a shaft encoder or sequence controller 100 driven in timed relation with shaft 72 by a drive 105. The controller operates the vacuum control valve to shut off vacuum to the grippers when the grippers reach a position around the positions indicated at 24, 1 in the path designated FP2 in FIG. 9, to release the carton for continued upward movement by the transfer mechanism. Thus, the carton infeed mechanism withdraws a carton from the stack and opens or erects the carton and then moves the carton to a position between the carton guides with the end panels P3 and P4 of the carton disposed alongside the carton guides and with the side panels P1 and P2 extending horizontally between the guides, and with the side and end flaps F1–F4 extending from the front and rear sides of the carton transfer mechanism.

A product loading mechanism 111 is provided for loading product into one end of the cartons as they are advanced past a carton loading station intermediate the upper and lower ends of the carton guides. The carton loading mechanism includes a horizonal conveyor 112, herein shown of the endless type, which is arranged to advance a product such as bags or pouches or other discreet articles along a generally horizontal path to a position adjacent the open end of the carton at the loading station. Product pushers 113 are provided at the product loading station. In the preferred embodiment illustrated, the conveyor 112 advances product along a path perpendicular to the open rear side of the transfer means and the product pusher is mounted for movement in a closed loop course shown at FP3 in FIG. 7 above the conveyor 112 sequentially downwardly and forwardly to push product off the conveyor and into a carton at the loading station, and then upwardly and rearwardly to a retracted position. The product pushers 113 are operated in timed relation with the reciprocation of the carton transfer mechanism and are arranged to move downwardly and forwardly from the position shown in FIGS. 5A and 7 to push product into the cartons while the carton slides are being retracted.

As best shown in FIG. 5A, the products pushers 113 are operated by a crank and rocker type four-bar linkage. The four-bar linkage includes a crank 114 mounted for rotation with a crank shaft **114*a*; a bar 115 rotatably connected at one end to a crank pin 114*b* at the outer end of the crank; and a link 116 that is pivotally mounted at its lower end for pivotal movement about a fixed pivot 116*a* and pivotally connected at its upper end by a pivot 116*b* to the bar 115. The pushers 113 are mounted on the forward end of an arm 113*a* that is rigidly secured to a pusher frame including cross-member 117*a* and side bars 117*b* rigidly secured to the ends of the cross member. The side bars are pivotally mounted at their forward ends by a pivot 117*c* to the forward ends of bars 115 and the side bars are pivotally mounted at their rear ends by a pivot 117*d* on the lower ends of links 118 that are pivotally supported at their upper ends in a fixed pivot 118*a*. The crank 114 is driven in a clockwise direction as viewed in FIG. 5A through one revolution during each reciprocation of the transfer slides to push product into the loading station while the cartons are dwelling during retraction of the slides. As shown in FIG. 5A, the crank is connected to a chain drive 119 to the output shaft of a gear box 126 that is connected through coupling 127 to the gear box 128 that drives shaft 72. The packaging machine is driven from an input drive shaft 129 that is preferably driven at a speed correlative with the speed at which filled pouches are supplied to the packaging machine to cycle the packaging machine in continuous fashion. Alternatively, the packaging machine can be intermittently cycled as through a one-revolution clutch connected to shaft 129 and which is actuated in response to advance of product to the loading station. The packaging machine is specially adapted for loading filled pouches and an endless belt type pouch compressor 120 is adjustably mounted above the product conveyor 112** and is driven in timed relation therewith by a drive (not shown) to compress the pouches to a uniform depth.

As best shown in FIGS. 5A, 7, 15A and 15B, end flap guides 121 are provided on the lateral carton guides 42, 42' adjacent the carton loading station and are arranged to guide the end flaps F3 and F4 on the rear ends of the cartons into outwardly diverging relation, as the cartons are advanced past the loading station. A product guide funnel 122 is mounted at the loading station of each transfer means for guiding product into the cartons. Each product guide funnel has its inlet end overlying the product conveyor 112 and its outlet end adjacent the open rear side of the carton transfer means. The product guide funnel includes lateral product guides **122*a* that converge adjacent their outlet end to a spacing no greater than the width of a carton, and a bottom wall 122*b* that is arranged to underlie and support the product as it is moved off the conveyor 112 and into the carton. The funnels are mounted on support bars 123 for reciprocation along a generally horizontal path toward and away from the respective transfer means between a retracted position shown in FIGS. 5A, 7 and 15A in which the outlet end of the funnel is spaced outwardly of the side flaps on the adjacent end of the carton at the loading station, to an extended position shown in FIG. 15B in which the outlet end of the funnel extends between the side flaps on a carton, when the crank 77 is moved 90° from the position shown in FIGS. 5A and 7. Plows 122*d* are provided at the outlet end of the funnel and are arranged to engage and spread the side flaps on the end of the carton when the funnel is extended. The funnel support bars 123 are guidably supported at their rear ends by followers 124 in guides 124*a*** and a mechanism described more fully hereinafter is connected to the forward ends of the funnel support bars to extend and retract the funnels in timed relation with reciprocation of the carton transfer mechanism.

Figure 7:
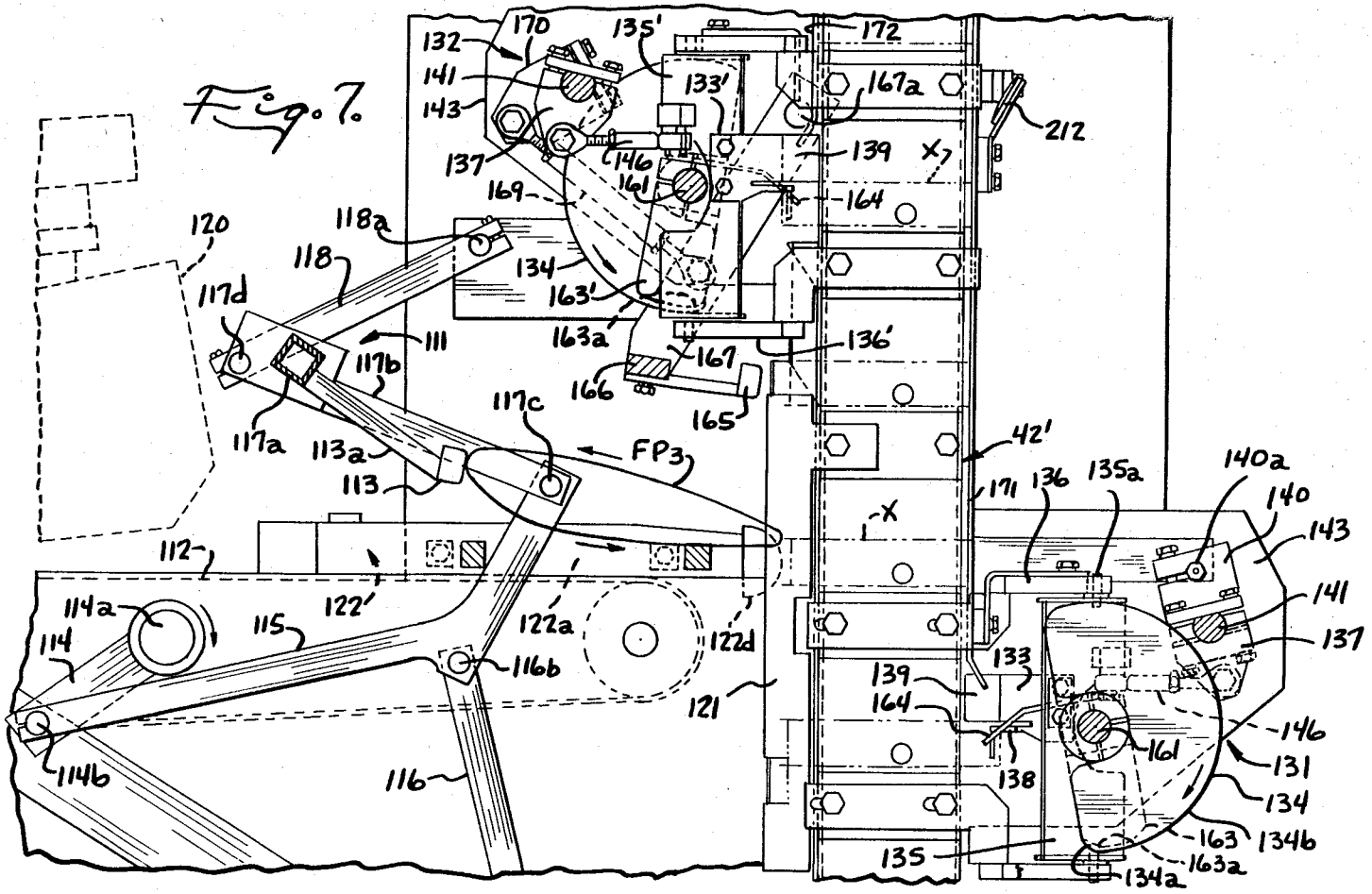
FIG. 7 is a fragmentary side elevational view taken on the plane 7—7 of FIG. 2 and illustrating parts on a larger scale than FIG. 5.
Figures 15A, 15B:
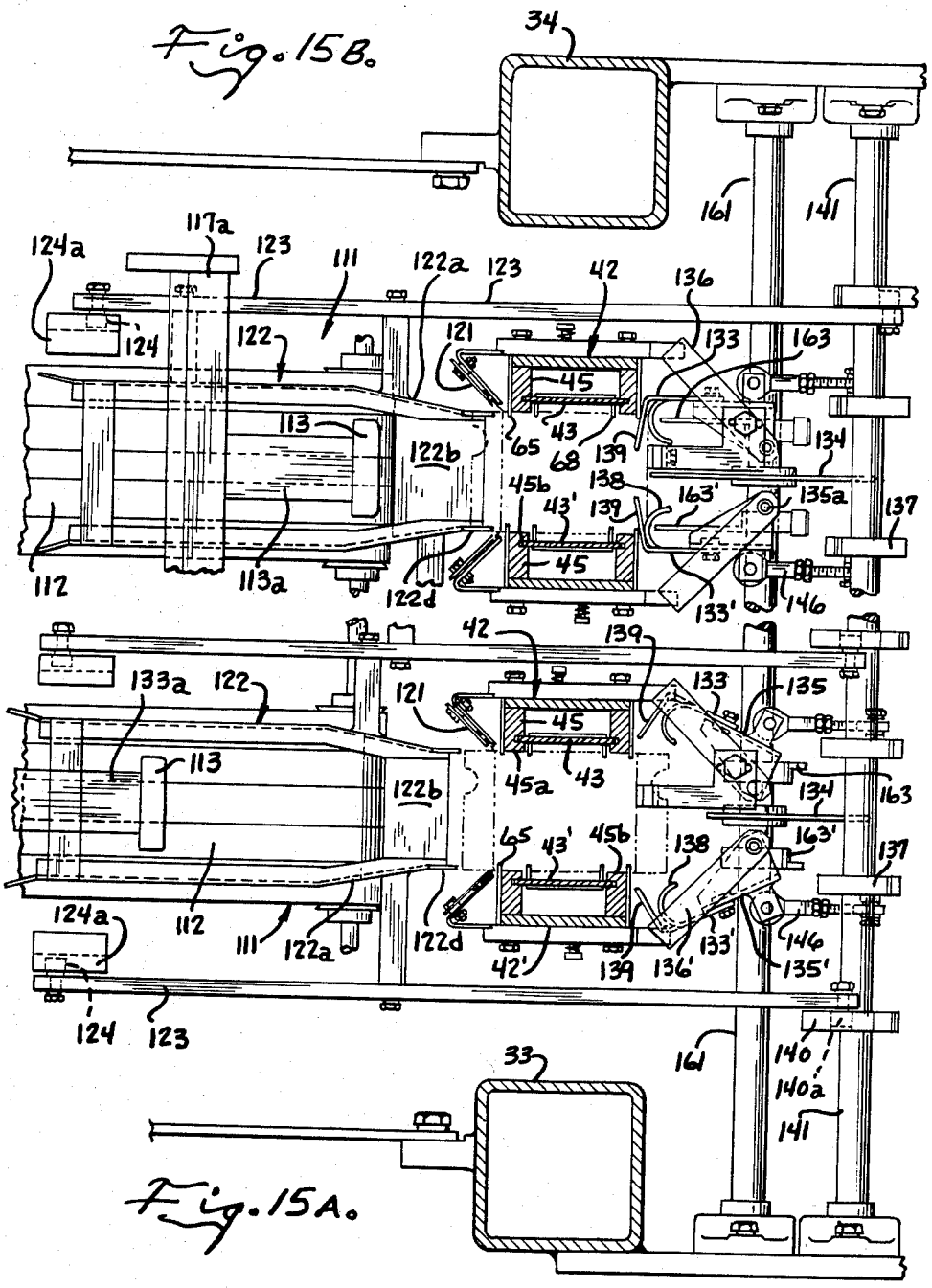
FIG. 15A is a fragmentary horizontal sectional view taken on the plane 15—15 of FIG. 5A.
FIG. 15B is a fragmentary horizontal sectional view taken on the plane 15—15 of FIG. 5A and showing parts in a different moved position than FIG. 15A.

Front and rear flap folding mechanisms 131 and 132 are provided for folding the flaps on the ends of the carton. The front flap folder 131 is preferably located at a level below the carton loading station and the rear flap folder 132 located at a level above the carton loading station. The flap folders are of like construction and like numerals are used to designate corresponding parts. The flap folders 131 and 132 each includes a pair of arms 133, 133' mounted for movement in a horizontal path toward and away from each other for infolding the end flaps, and a side flap folding cam 134 movable through a flap folding cycle to engage and fold the side flaps on end of the side panels upwardly. As best shown in FIGS. 7, **15*a* and 15*b*, the arms 133, 133' are attached to members 135, 135' that are pivotally mounted by pivots 135*a* on brackets 136, 136' that are attached to the carton guides 42, 42' respectively. The arms 133, 133' are mounted for horizontal swinging movement about the pivots 135*a* and each have an end flap folding finger 138 that is arranged to engage and infold an end flap on the respective end of the carton when the arms are moved toward each other to an end flap folding position. The end flap folding fingers 138 are preferably horizontally curved as best shown in FIGS. 15A and 15B to cam the end flaps inwardly. The arms also have a carton hold-down finger 139 that is arranged to overlie the upper one of the side panels on the respective end of the carton when the arms are in their end flap folding position, to restrain upward movement of the end of the carton. The arms 133, 133' are operated in timed relation with the slide from a rocker shaft 141 that is rotatably supported in bearings 142 on mounting plates 143 secured to the upright frame members 33, 34. Crank arms 137 are attached to the shaft 141 and are connected through links 146 to a respective one of the members 135 at locations outwardly of their pivots 135*a* to swing the arms 133, 133' in relatively opposite directions in response to angular oscillation of the shaft 141. Arms 140 are also provided on the shaft 141 of the front flap folding mechanism and the arms 140 are pivotally connected at 140*a* to the forward ends of funnel support bars 123** to reciprocate the funnels.

The shafts 141 are oscillated under the control of a cam 144 (FIG. 3A) mounted on the drive shaft 72 for rotation therewith. A lever 147 is pivotally mounted at a fixed pivot 148 at one end and has a follower 149 intermediate its ends that rides on the cam 144. A tension spring 151 is connected to the other end of the lever to maintain the follower in engagement with the cam, and the lever is connected through a link 152 to an arm 153 that is non-rotatably connected to the shaft 141 associated with the rear flap folder. The shaft 141 associated with the rear flap folder has an arm 154 that is connected through a link 155 to an arm 156 that is non-rotatably secured to the shaft 141 associated with the front flap folder. The cam 144 has a nose portion **144*a* operative, when the cam is rotated from the position shown in FIG. 3A, to raise the arm 147 and oscillate the shaft 141 of the rear flap folding mechanism in a counter clockwise direction to move the rear flap folding fingers into their end flap folding position, and the arm 154, link 155 and arm 156 operate the shaft 141 on the front flap folding mechanism in a clockwise direction to similarly move the front flap folding arms inwardly to their end flap folding position. The cam nose 144*a* holds the end flap folding arms in their end flap folding position for a portion of the revolution of the cam 144, until the side flap folding cam 134** folds the side flaps on the end of the carton upwardly.

The side flap folding cams 134 for the front and rear folding mechanisms are of like construction and like numerals are used to designate corresponding parts. The side flap folding cams 134 are mounted on a cross shaft 161 that is rotatably supported in bearings 162 on the mounting plates 143. The cams 134 are fixed to shaft for rotation therewith at a location substantially medially between the end flap folding fingers 133, 133' and have a nose portion **134*a* arranged to engage the side flaps on the respective end of the carton to fold both the lower and upper side flaps upwardly, and the cam has a semi-circular periphery 134*b* arranged to hold the side flaps in an upwardly folded condition until the transfer mechanism starts to advance the cartons away from the flap folding station. The side panels on cartons, particularly when formed of light weight stock, tend to bow upwardly when flap folding pressure is applied only at the center of the flaps. In order to aid in folding the side flaps upwardly, a pair of side flap folding members 163, 163' are mounted on the shafts 161 at opposite sides of the cam 134 and at locations to move across the end flap folding fingers when they are in their end flap folding position as shown in FIG. 15B. The members 163, 163' each have nose 163***a* at their outer ends that is arranged to engage the side flaps in an area adjacent the end panels on the carton and at a location where the upper side panel on the carton is engaged by the carton hold-down finger. The nose portion 163*a* on the members 163 engages the side flaps on the carton during only a small portion of each revolution and move away from the end flap folding fingers to allow retraction of the end flap folding fingers before the transfer means advances the cartons in a succeeding cycle. In order to prevent the upper side flap from interfering with infolding of the end flaps, an upper side flap deflecting finger 164 is mounted on each of the side flap folding members 163, 163' and has an outer end angularly advanced relative to the nose 163*a* on the respective side flap folding member and arranged to engage the side flap at the upper side of the carton and deflect it upwardly before the end flap folding members are moved to their end flap folding position. Front and rear flap hold-down bars 171 and 172 extend upwardly from the respective front and rear flap folding stations along a path to hold the side flaps on the carton in a folded condition.

The shafts 161 are rotated through one revolution in timed relation with the movement of the slides and the end flap folding fingers. As shown in FIG. 10, a sprocket 174 on shaft 72 is connected through a chain 175 that is entrained over idler sprockets 176, 177 and over sprockets 178 and 179 on shafts 161, and over another idler sprocket 180. The chain is so arranged as to rotate the shaft 161 associated with the front flap folding mechanism in a counterclockwise direction as shown in FIG. 10, and to rotate the shaft 161 associated with the rear flap folding mechanism in a clockwise direction as viewed in FIG. 10, to fold the side flaps on the front and rear ends of the carton upwardly. The slides are shown in their raised position in FIGS. 5A and 5B, and the flap folding cams 134 are rotated through one-half revolution from the position shown in FIG. 5A as the slides are retracted to their lower position, and the cams 134 are rotated back to the position shown in FIG. 5A when the slides are moved back to their raised position.

Secondary product pushers 165, one for each lane of the packaging machine, are mounted at a location above the product loading station and below the rear flap folding mechanism 132. As best shown in FIG. 7, secondary product pushers 165 are mounted on a cross bar 166 that is supported for swinging movement along a generally horizontal path by arms 167 pivoted at 167*a*. The secondary product pushers are operated in timed relation with the transfer mechanism by a link 169 connected to an arm 170 on the rocker shaft 141 of the rear flap folding mechanism. The secondary product pushers 165 are moved forwardly to press the product firmly in the containers while the cartons are dwelling during retraction of the transfer slides.

Figure 1:
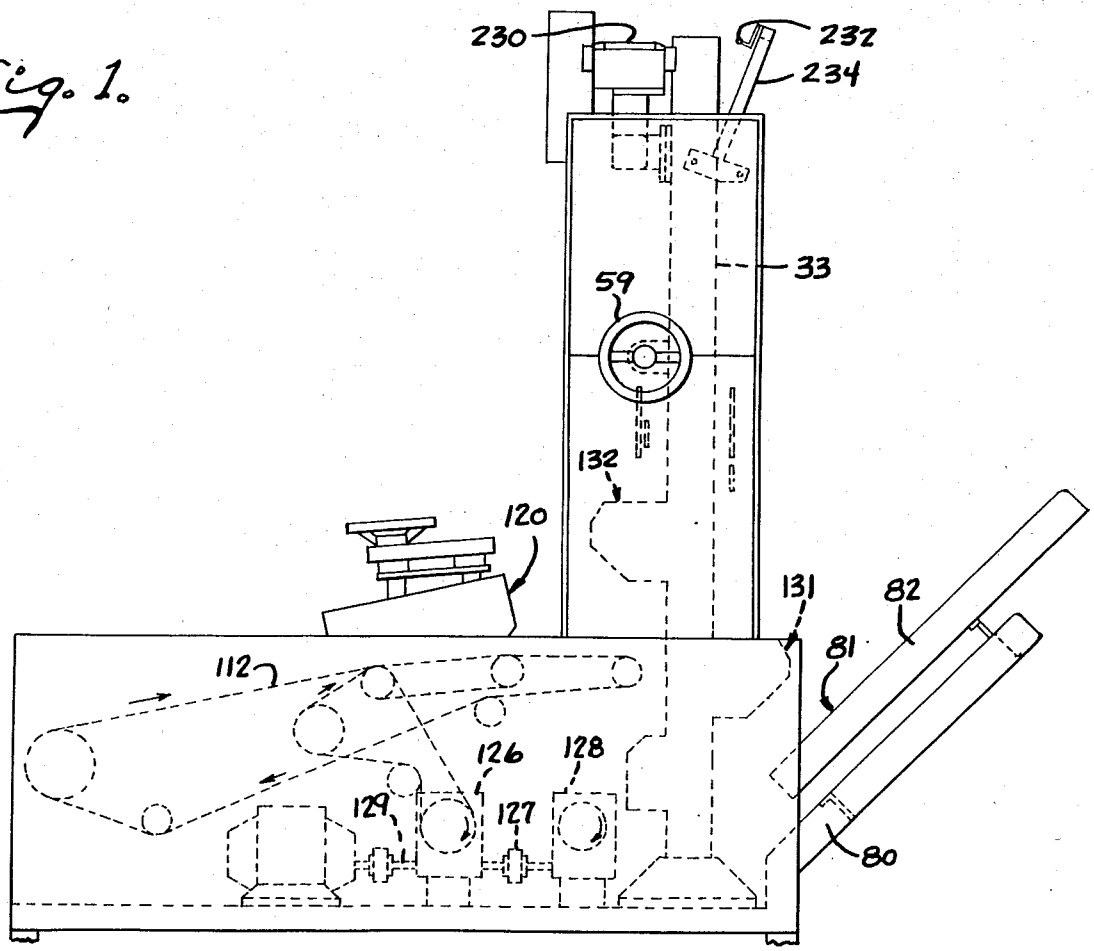
FIG. 1 is a side elevational view of the packaging apparatus.
Figure 2:
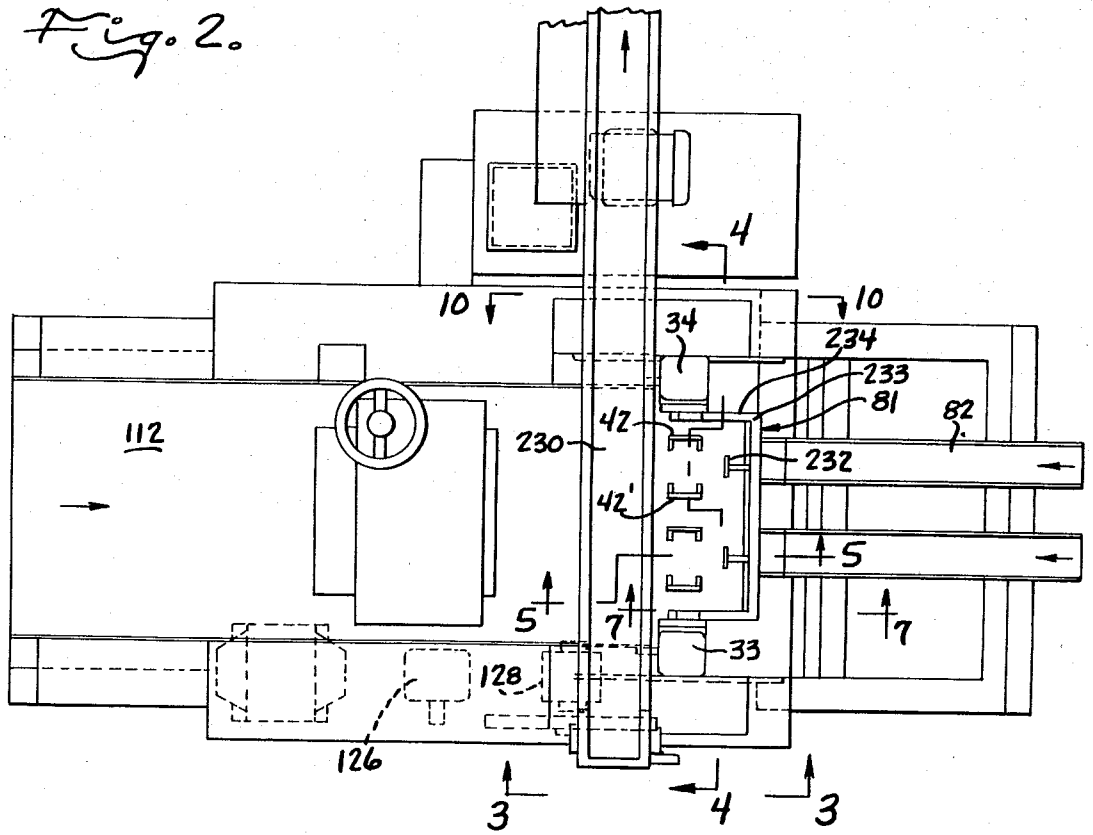
FIG. 2 is a diagrammatic top plan view.
Figure 3A:
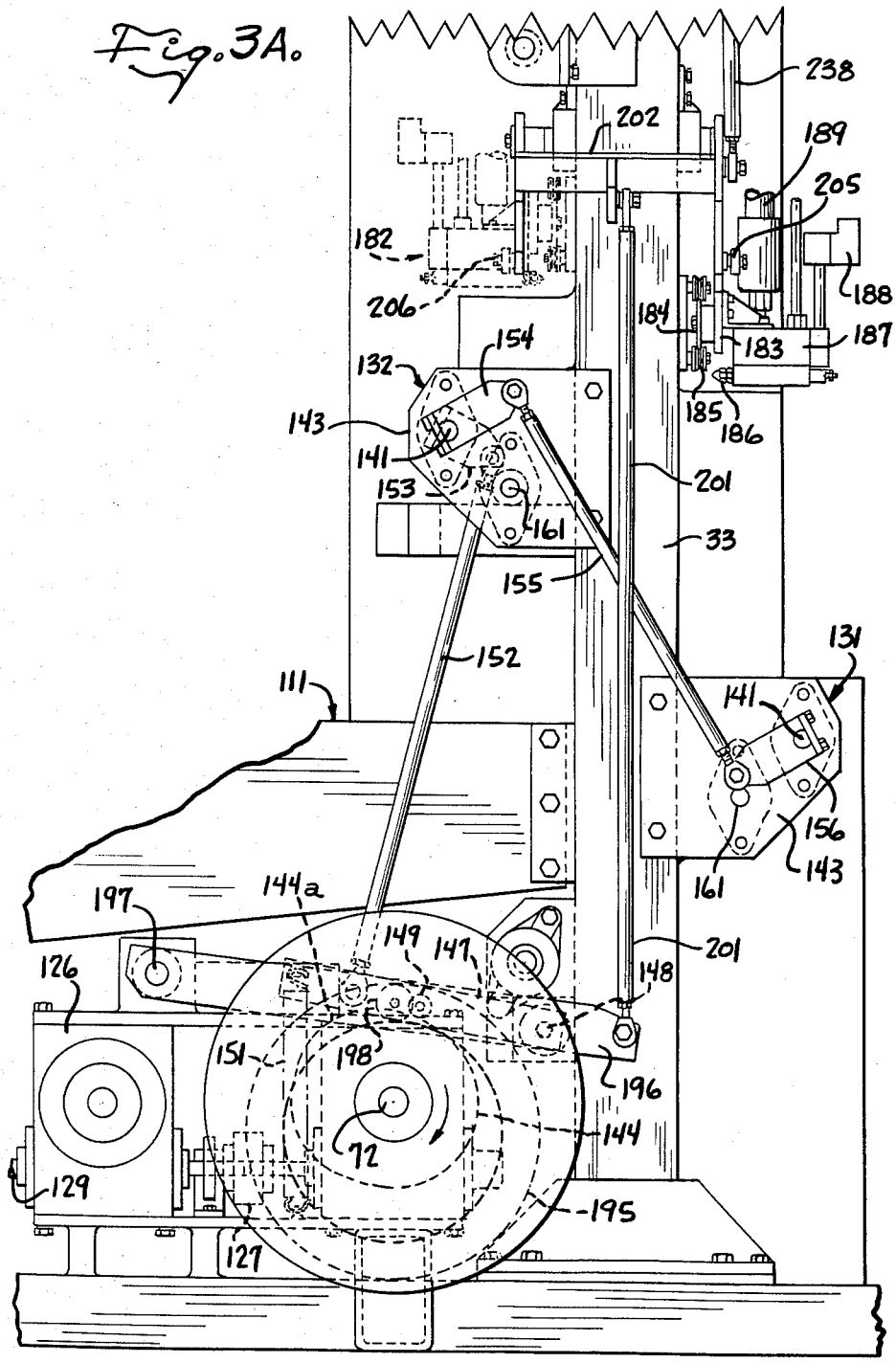
FIGS. 3A and 3B are different portions of a fragmentary side elevational view taken on the plane 3—3 of FIG. 2 and showing the parts on a larger scale.

Front and rear adhesive applicators 181 and 182 are provided for applying adhesive to one of the side flaps on the front and rear end of the cartons. The front and rear adhesive applicators are of like construction and like numerals are used to designate corresponding parts. The front and rear adhesive applicators are mounted for horizontal movement across the respective front and rear sides of the transfer mechanism and each include a generally horizontally disposed support bar 183 having a track 184 at each end supported by rollers 185 on the upright frame members 33 and 34 for rectilinear movement. Each bar 183 is reciprocable along a horizontal path and each adhesive applicator includes an adhesive distribution manifold 187 having adhesive applying nozzles 186 mounted thereon. One adhesive nozzle 186 is provided for each lane of the machine and a separate solenoid operated valve 188 is provided on the manifold to control the flow of adhesive to the associated one of the nozzles 186. The manifold is connected through a flexible tube 189 to a source of liquid adhesive such as hot melt adhesive. The nozzles 186 are preferably located with relation to the transfer mechanism so as to apply a band of adhesive to the upwardly folded end flap on the upper side panel on the respective end of the carton, and the nozzles are reciprocated crosswise of the path of movement of the cartons in timed relation with the reciprocation of the transfer slides, and while the slides are being retracted. As best shown in FIG. 3A, the adhesive applicators are reciprocated by a cam 195 on the main shaft 72. A lever 196 is pivoted on a fixed pivot 197 at one end and has a follower 198 intermediate its ends that engages the cam track 195. The other end of the lever 196 is connected through a link 201 to a bell crank lever 202 that is pivotally mounted at 203 on one of the upright frame members 33. The bell crank member 202 is otherwise connected through a link 205 to the bar 183 associated with the front adhesive applicator 181, and by a similar link (not shown) to the bar 183 associated with the rear adhesive applicator 182, to reciprocate the adhesive applicators in timed relation with each other and with the reciprocation of the transfer slides.

Provision is made for preventing the dispensing of adhesive in the absence of a carton at the adhesive applying location. For this purpose, a photoelectric detector 211 (FIG. 5A), one for each of the lanes of the machine, is mounted to direct a light beam across the path of movement of the cartons to a mirror 212 at the other side of the path, to detect the presence or absence of a carton at the front adhesive applying location. The photoelectric detector is connected to circuitry (not shown) for controlling operation of the adhesive applicator valves and which is operative, when a carton is not present at the location adjacent the front applicator, to prevent dispensing of adhesive by the front adhesive applicator 181 and to also prevent dispensing of adhesive by the rear adhesive applicator on the next succeeding cycle of the transfer mechanism.

Upper side flap folding plows 215 and 216 are provided at the front and rear sides of the transfer mechanism and arranged to engage the side flap on the upper panel of the cartons as the cartons are moved away from the respective front and rear adhesive applying station, to fold the upper side flaps downwardly into overlying relation with the upwardly folded lower side flap. Front flap hold-down bars 217*a*, 217*b*, and rear flap holddown bars 218 extend upwardly from the respective front and rear flap folding shoes 215 and 216, to hold the upper side flaps in a downwardly folded condition as the cartons are advanced upwardly to the carton discharge station. The front hold-down bars 217*b* are mounted on arms 160 that are swingably supported by pins 160*a* on brackets 160*b* secured to the lateral carton guides 42, 42' to enable the front hold-down bars to be moved to an open portion to facilitate removal of cartons from the guideways in the event of a carton jam in the machine. Any suitable means may be provided to releasably latch the hold-down bars in their closed position and, in the embodiment shown, the arms 160 are adapted to seat in the upper side of brackets 160*a* and the arms can be lifted up out of the notches in order to enable swinging of the hold-down bars to an open position.

A carton receiving means is provided adjacent the upper end of the carton transfer mechanism and cartons are discharged from the transfer mechanism onto the carton receiving means. In the embodiment illustrated, the carton receiving means is in the form of an endless belt conveyor 230 that extends along the rear side of the carton transfer mechanisms adjacent their upper ends. The cartons are discharged from the carton transfer mechanism onto the conveyor by pushers 232 mounted for movement crosswise of the carton transfer mechanisms. The pushers 232 are mounted on a cross head 233 that is supported on arms 234. The lower ends of the arms 234 are attached to stub shafts 235 and 236 that are rotatably supported in the upright frame members 33 and 34 and one of the stub shafts 236 has an arm 237 that is connected through a link 238 to the bell crank 202. Thus, the carton discharge pushers 232 are operated from the cam 195 and are moved rearwardly to discharge cartons from the transfer mechanism while the slides are retracting.

A modified form of flap folding mechanism is illustrated in FIGS. 17–24. In this embodiment, like numerals are used to designate parts that are the same as in the embodiment of FIGS. 1–16, and like numerals followed by the postscript " are used to designate modified parts. In FIGS. 17–24, only a front flap folding mechanism 131" is shown which is substituted for the front flap folding mechanism 131 of FIGS. 1–16, it being contemplated that a similar rear flap folding mechanism be substituted for the rear flap folding mechanism 132 of FIGS. 1–16.

The flap folding mechanism 131" includes cross members 251" and 252" that are telescopically interconnected for relative reciprocation along their lengthwise axes and extend crosswise of the carton transfer mechanism 41". Bell cranks 253" and 254" are pivotally mounted at 255" on brackets secured to the mounting plates 143. Links 146" are pivotally connected at one end by a pin 257" to one arm of each bell crank and the links are pivotally connected at their other ends by pins 258" to an arm 137" on the rocker shaft 141, such that the bell cranks 253" and 254" are angularly oscillated in relatively opposite directions in response to angular oscillation of the rocker shaft 141. Cross member 251" is supported at its outer end on bell crank 253" and the cross member 252" is supported at its outer end on bell crank 254" to effect relative reciprocation of the cross members in response to angular oscillation of the bell cranks. For reasons that will be apparent hereafter, the cross members are supported on the bell cranks in a manner to allow limited angular oscillation of the cross members about their lengthwise axis. The cross member 251" has a circular cross section and a bushing 261" rotatably receives the outer end of that rod. The bushing has a rectangular outer cross section that is non-rotatably received in a forked end 253*a*" or the bell crank 253". A pin 262" extends through the forked end 253*a*" of the bell crank and through bushing 261" and cross member 251" and interconnects the cross member to the bell crank for relative pivotal movement about the axis of the pin 262". As best shown in FIG. 23, the cross member 251" is provided with a transversely enlarged opening 251*a*" for receiving the pin 262" and which is arranged to allow limited axial turning of the cross member relative to the bell crank. As best shown in FIG. 24, a stub shaft 252*a*" is fixed on the outer end of cross member 252" and a bushing 264" rotatably receives the stub shaft. The bushing 264" also has a rectangular outer cross section and is non-rotatably supported in the forked end 254*a*" (FIGS. 17 and 18) of the bell crank 254". A pin 265" extends through the forked end 254*a*" of the bell crank 254" and through bushing 265" and stub shaft 252*a*" to pivotally interconnect the same. The stub shaft has a transversely enlarged opening 252*b*" (FIG. 24) for receiving the pin and to allow limited axial turning of the stub shaft and cross member 252" relative to the bell crank.

Figures 17, 18:
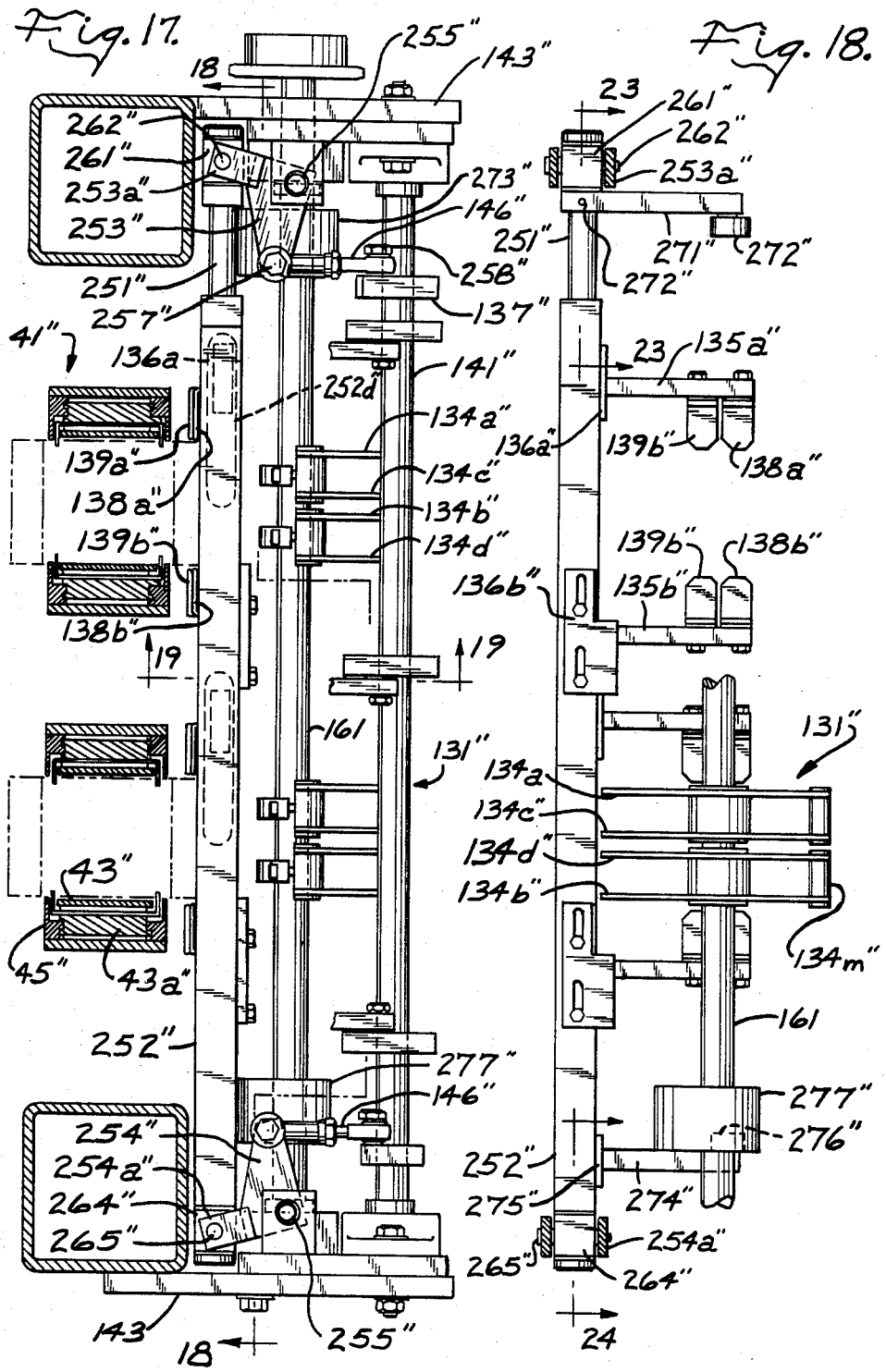
FIG. 17 is a fragmentary horizontal sectional view illustrating a modified form of flap folding mechanism.
FIG. 18 is a fragmentary vertical sectional view taken on the broken line plane 18—18 of FIG. 17.

A cam follower arm 271" is non-rotatably secured as by a pin 272" to the cross member 251" and has a follower roller 272" on its outer end that engages a cam 273" on shaft 161. A spring (not shown) yieldably urges the cam follower arm in a direction to maintain the cam follower in engagement with cam 273". Similarly, a cam follower arm 274" (FIG. 18) is non-rotatably secured to the cross member 252" as by a bracket 275" and has a cam follower roller 276" at its outer end that engages a cam 277" on shaft 161 and a spring (not shown) yieldably urges the cam follower arm in a direction to maintain the cam follower in engagement with cam 277". Each flap folding mechanism 131" includes a pair of end flap folding fingers 138*a*" and 138*b*" for each lane of the packaging machine. Fingers 138*a*" are attached as by an arm 135*a*" and bracket 136*a*" to one of the cross members 251" and the other fingers 138*b*" are attached as by an arm 135*b*" and bracket 136*b*" to the other cross member 252". The brackets 136*a*" and 136*b*" are advantageously attached to their respective cross members for adjustment therealong to accommodate different size cartons, and the outer cross member 252" has elongated openings 252*d*" (FIG. 17) at its underside to accommodate movement of the brackets 136*a*" during reciprocation of the cross members. The end flap folding fingers 138*a*', 138*b*" are arranged to engage and infold the end flaps. Carton hold-down fingers 139*a*", 139*b*" are advantageously provided on the arms 135*a*", 135*b*" at a location above the end flap folding fingers and the hold-down fingers are offset from the end flap folding fingers as best shown in FIG. 17 to overlie the upper end panel on the carton when the end flap folding fingers are in their end flap folding position.

Side flap folding cams 134*a*–134*d*" are mounted on the shaft 161, for rotation therewith and, as best shown in FIGS. 19 and 20, have semi-circular peripheries arranged to engage the side flaps on the cartons and fold the same upwardly. The side flap folding cams are advantageously arranged in paris 134*a*", 134*c*" and 134*b*", 134*d*" that can be adjusted along the shaft to accommodate different size cartons. The cams 134*a*", 134*b*" are advantageously arranged to move in planes that extend crosswise of the end flap folding fingers 138*a*", 138*b*" respectively, when the end flap folding fingers are in their end flap folding position.

As previously described in connection with the embodiment of FIGS. 1–16, the shaft 141 is angularly oscillated during retraction of the transfer slides and the shaft 161 is rotated through one revolution during each cycle of the transfer mechanism. Rocker shaft 141 acting through arms 137" and bell cranks 253" and 254" reciprocates cross members 251" and 252" in relatively opposite directions to move the end flap folding fingers 138*a*″ and 138*b*″ in a first direction crosswise of the open side of the transfer mechanism toward and away from each other. Rotary shaft 161 acting through cams 273″, 277″ and follower arms 271″, 274″, angularly oscillates the cross member about their lengthwise axis, to move the end flap folding fingers in a second direction transverse to the first direction, toward and away from the open side of the transfer mechanism. The relative reciprocation of the cross members 251″, 252″ is timed with the angular oscillation of the cross members about their lengthwise axis and with the reciprocation of the transfer slides such that the flap folding fingers are moved toward and away from each other as indicated by the line M in the graph of FIG. 21 and are moved toward and away from the open side of the transfer mechanism as indicated by the line N in the graph of FIG. 21. The end flap folding fingers are in a dwell position as shown at Pa1, Pb2 in FIG. 22, before the transfer mechanism starts its retraction stroke and, when the end flap folding fingers are in their dwell position, the distal ends of the flap folding fingers are spaced outwardly of the carton guide planes of the transfer mechanism and laterally from the open side of the transfer mechanism.

In the graph of FIG. 21, 0° corresponds to top dead center of crank 97 in which the transfer slides are in their fully raised position. While the transfer mechanism is retracted between 0° to 180°, the cartons do not move and the end flap folding fingers 138*a*″ and 138*b*″ are moved from their dwell positions Pa1 and Pb1 in FIG. 22 in a curved path both toward each other and laterally toward the transfer mechanism as indicated by the line portions M1 and N1 in FIG. 21 to a second position designated Pa2, Pb2 in FIG. 22 to infold the end flaps. In their second position, the fingers 138*a*″ and 138*b*″ extend inwardly of the lateral carton guide planes of the transfer mechanism and are disposed adjacent a plane through the open side of the transfer mechanism. The fingers remain in their extended position for a short interval for example as the crank rotates between 76° and 105° as indicated by line portion M2 in FIG. 21 and are then retracted as indicated by the line M3 as the crank rotates between 105° and 195°. The cams 273″ and 277″ maintain the end flap folding fingers in a position adjacent the plane through the open side of the transfer mechanism as the fingers are retracted, as shown by the line portion N2 in FIG. 21, such that the fingers are retracted away from positions Pa2, Pb2 along a generally linear path paralleling the open side of the transfer mechanism to a positions designated Pa3, Pb3 in FIG. 22. The end flap folding fingers are disposed outwardly of the lateral carton guide planes of the transfer mechanism in positions Pa3, Pb3 and the cams 273″, 277″ thereafter move the fingers laterally away from the transfer mechanism as indicated by the line portion N3 in FIG. 21 back to their dwell positions Pa1, Pb1.

The side flap folding cams 134*a*–134*d*″ are rotated with shaft 161 in timed relation with the shaft 141 and in timed relation with the movement of the end flap folding fingers. The side flap folding cams are positioned as shown in FIG. 20 when the crank 77 is at 0°, with their lead nose 134*n*″ angularly spaced from the lower side flap on the carton at the flap folding station. When the end flap folding fingers are in their position Pa2, Pb2 in FIG. 22, at about 75°, the side flap folding cams are in a position as shown in FIG. 19 in which the lead nose 134*n*″ is adjacent the underside of the lower side flap. The side flap folding cams fold the side flaps upwardly as the nose 134*n*″ moves past the side flaps and the semi-circular periphery of the side flap folding cams holds the side flaps in their upwardly folded condition while the end flap folding fingers are retracted to the positions Pa3, Pb3. Thus, the end flap folding fingers infold the end flaps and position and hold the carton during upward folding of the side flaps. The carton hold-down fingers 139*a*″, 139*b*″ engage the top panel on the carton during folding of the side flaps to inhibit buckling of the top panel of the carton and to hold the cartons against upward movement.

A modified form of transfer mechanism 41″ is illustrated in FIGS. 17 and 22. The transfer slides 43″ have guides 43*a*″ on their inner sides that are guidably received in grooves in the ways 45″ on the lateral carton guides 43″. This arrangement aids in protecting the relatively sliding surfaces of the transfer mechanism from external contamination. The transfer mechanism 41″ is otherwise structurally and operationally similar to that described in connection with FIGS. 1–17.

From the foregoing it is thought that the construction and operation of the packaging machine will be readily understood. The carton transfer mechanism advances the cartons in step fashion along an upright path from a carton infeed station adjacent the lower end of the carton guides past a carton loading station to a carton discharge station adjacent the upper ends of the carton guides. This arrangement occupies a minimum floor space and also provides convenient operator access to the cartons as they are advanced along the upright transfer mechanism. This enables the operator to remove and correct carton jam-ups in the machine and is of particular advantage in multi-lane machines. Further, the upright transfer mechanism discharges the cartons at an elevated position where they can be easily transported to a subsequent collating or boxing station.

The carton magazines are located at the front of the machine and the carton infeed mechanism is mounted for movement in a plane parallel to and between the carton guides to remove an end carton from the stack in the magazine and to feed the end carton with one open end leading to a position between the lateral carton guides. The linkage mechanism described moves the vacuum operated gripper means in a closed loop path that extends generally perpendicular to the face of the end carton in the stack as the grippers move into and out of carton pick-up position, and which closed loop path has an upward component of movement as the gripper means moves to its carton delivery position between the carton guides. This provides a smooth transfer of the cartons from the gripper to the carton transfer mechanism.

The flap folding mechanism sequentially infolds the end flaps on the carton and holds the carton against upward movement during upward folding of the side flaps on the end of the carton. The adhesive applicators thereafter apply adhesive on one side flap on the carton and the upper side flap is thereafter folded downwardly to close and seal the carton. The adhesive sets as the cartons are advanced upwardly through the upper portion of the transfer mechanism and the sealed cartons are thereafter discharged onto the receiver at the upper end of the transfer mechanism.

The embodiments of the invention in which an exclusive property or privilege is claimed are defined as follows:

1. A packaging machine for feeding, erecting, loading and closing cartons of the type having a pair of side panels connected along fold lines to a pair of end panels and side and end flaps on opposite ends of the respective side and end panels, the packaging machine comprising: an upright carton transfer means extending from a carton infeed station adjacent its lower end past a carton loading station to a carton discharge station adjacent the upper end of the carton transfer means, the carton transfer means including a pair of generally vertically extending lateral carton guides defining parallel carton guide planes, the carton transfer means being open along front and rear sides thereof between the guide planes, a plurality of carton supports at spaced locations along the lateral carton guides each adapted to underlie and support a carton after it is advanced therepast, a transfer slide mounted for reciprocation along each carton guide and having a plurality of pushers at spaced locations along the slides operative when the slide is moved upwardly to advance a plurality of cartons upwardly in step fashion, a carton magazine for storing a stack of flattened carton blanks with one and of the stack adjacent the carton infeed station, carton infeed means for withdrawing a flattened carton blank from said one end of the stack and for erecting and feeding the erected carton to the carton guides with the end panels of the carton disposed alongside the carton guides and side panels extending horizontally between the guides and with the side and end flaps extending through the open front and rear sides of the carton transfer means, drive means for reciprocating the transfer slides, means for operating the carton infeed means in timed relation with the reciprocation of the transfer slides, carton loading means for feeding product along a generally horizontal path into a carton at the loading station, means intermediate the upper and lower ends of the carton transfer means for infolding the side and end flaps on the cartons, carton receiving means adjacent the upper ends of the carton transfer means, and means adjacent the upper end of the carton transfer means for discharging cartons from the carton transfer means onto the receiving means.

2. A packaging machine according to claim 1 wherein said carton infeed means includes a feed member, means for oscillating the feed member in a plane that extends between and parallel to the carton guide planes at the carton infeed station, the carton magazine being located at the open front side of the carton transfer means and supporting the flattened carton blank at said one end of the stack in a plane perpendicular to the plane of oscillation of the feed member, vacuum operated gripper means mounted on the feed member and having a carton engaging face disposed perpendicular to the plane of oscillation of the feed member, the vacuum operated gripper means being movable with the feed member between a carton pick-up position with its carton engaging face parallel to and engaging a carton blank at said one end of the stack in the magazine and a carton delivery position intermediate the carton guides with the carton engaging face disposed upwardly.

3. A packaging machine according to claim 2 wherein carton magazine supports the carton at said one end of the stack in a plane that diverges downwardly relative to the front side of the carton transfer means.

4. A packaging machine according to claim 3 wherein the means for oscillating the feed member moves the gripper means in a closed loop path sequentially from its carton pick-up position in a direction transverse to the face of the end carton in the stack to erect the carton blank and then with one open end of the carton leading into a position between the lateral carton guides and then in an upward curve through its carton delivery position and thereafter back to its carton pick-up position.

5. A packaging machine according to claim 2 wherein said drive means includes a crank mounted for rotation about a horizontal axis perpendicular to the plane of oscillation of the feed member, a link means connecting the crank to the slides for reciprocating the slides in response to rotation of the crank, said means for oscillating the feed member including a bar rotatably connected at one end to the crank and pivotally connected intermediate its ends to said feed member to oscillate the feed member in timed relation with the reciprocation of the slides.

6. A packaging machine according to claim 2 wherein said means for oscillating the feed member includes a crank mounted adjacent the rear side of the carton transfer means for rotation about a horizontal axis perpendicular to the plane of oscillation of the feed member, a bar rotatably connected at one end to the crank and extending forwardly between the pair of carton guides to the front side of the carton transfer means, means pivotally connecting the bar intermediate its ends to the feed member, a link pivotally mounted at its upper end adjacent the front side of the guide means for swinging movement about a horizontal axis perpendicular to the plane of oscillation of the feed member and pivotally connected at its lower end to the forward end of the bar.

7. A packaging machine according to claim 6 wherein the drive means for reciprocating the slides includes a link connecting said crank to the slides.

8. A packaging machine according to claim 6 wherein said feed member is vertically elongated and is pivotally connected intermediate its ends to said bar, said gripper means being mounted on the upper end of the feed member, and means for guiding the lower end of the feed member to position the carton engaging face on the gripper means parallel to the plane of the end carton in the magazine when the gripper means is moved to its carton pick-up position and to position the carton engaging face on the gripper means substantially horizontal when the gripper means is moved to its carton delivery position.

9. A packaging machine according to claim 1 wherein said means for loading product includes conveyor means for advancing product to the loading station, a product guide funnel having an inlet and an outlet end, means mounting the product guide funnel at the loading station for reciprocation along a generally horizontal path toward and away from the transfer means between a retracted position in which the outlet end of the funnel is spaced outwardly from the side flaps on the adjacent end of the carton and an extended position in which the outlet end of the funnel extends between the side flaps, means for extending and retracting said product guide funnel in timed relation with reciprocation of the slides, a pusher mounted at the loading station for movement from a retracted position to an extended position and back to push product off the conveyor and through the funnel and into a carton at the loading station, and means for operating said pusher between its retracted and extended position in timed relation with reciprocation of the slides.

10. A packaging machine according to claim 9 wherein the lead end of the funnel has plow means arranged to engage and spread the side flaps on the end of the carton as the funnel is extended, and the funnel has a bottom wall adapted to underlie and support the product as it is pushed into the carton.

11. A packaging machine according to claim 1 wherein said means for infolding the flaps includes at least one flap folding mechanism adjacent one of the open sides of the carton transfer means at a flap folding location, said flap folding mechanism including a pair of arms mounted for movement toward and away from each other, said arms each having end flap folding fingers arranged to engage and infold end flaps on one end of the carton when the arms are moved toward each other to an end flap folding position, the arms each having a second finger arranged to overlie the upper one of the side panels at said one end of the carton when the arms are in said end flap folding position to restrain upward movement of said one end of the carton, side flap folding means mounted for movement through a flap folding cycle to engage and fold the side flaps on one end of the side panels upwardly, and means for operating said flap folding mechanism in timed relation with the reciprocation of the slides.

12. A packaging machine according to claim 11 wherein said side flap folding means includes at least one side flap folding cam mounted for rotation about a horizontal axis in a generally upright path when the pair of arms are in their end flap folding position, the side flap folding cam having a semi-circular periphery arranged to hold the side flaps in an upwardly folded condition during a portion of each revolution of the side flap folding cam and until the transfer means advances a carton away from the flap folding station.

13. A packaging machine according to claim 11 including an adhesive applicator nozzle mounted for reciprocating movement along a horizontal path at an adhesive applying location above at least one said flap folding locations to apply a band of adhesive to one of the upwardly folded side flaps, means for reciprocating the nozzle in timed relation with the reciprocation of the slides, and a side flap folding means engageable with the side flap on the upper side panel for folding it downwardly as the cartons are advanced upwardly away from said adhesive applying location.

14. A packaging machine according to claim 11 wherein the side flap folding means includes a horizontal rotary shaft spaced from one open side of the transfer means at the flap folding location, at least one side flap folding cam mounted on the rotary shaft for rotation therewith in a generally upright path intermediate the end flap folding fingers when the pair of arms are in their flap folding positions, a pair of side flap folding members mounted on the rotary shaft for rotation therewith in generally upright planes that extend across a respective one of the end flap folding fingers when the pair of arms are in their flap folding position, means for rotating the rotary shaft in timed relation with the movement of the end flap folding arms, said pair of side flap folding members having a side flap engaging nose on their outer ends arranged to move upwardly across the end flap folding fingers when they are in their end flap folding position, said side flap folding cam having a semi-circular periphery arranged to hold the side flaps in an upwardly folded condition during a portion of each revolutioon of the rotatable shaft.

15. A packaging machine according to claim 14 including at least one upper side flap deflecting finger mounted on the rotatable shaft for rotation therewith and arranged to engage the side flap at the upper side of the carton and deflect it upwardly before the end flap folding fingers are moved to their end flap folding position.

16. A packaging machine according to claim 14 including an upper side flap deflecting finger mounted on each of said pair of side flap folding members and each having an outer end angularly advanced relative to the flap engaging nose on the respective side flap folding members and arranged to engage the side flap at the upper side of the carton and deflect it upwardly before the end flap folding fingers are moved to their end flap folding position.

17. A packaging machine according to claim 11 wherein said means for operating the flap folding mechanism includes a horizontal rocker shaft spaced from one of the open sides of the transfer mechanism, and means including links connecting the rocker shaft to said pair of arms to move the arms in response to angular oscillation of the rocker shaft.

18. A packaging machine according to claim 17 wherein said means for loading product includes conveyor means for advancing product to the loading station, a product guide funnel having an inlet and an outlet end, means mounting the product guide funnel at the loading station for reciprocation along a generally horizontal path toward and away from the transfer means between a retracted position in which the outlet end of the funnel is spaced outwardly from the side flaps on the adjacent end of the carton and an extended position in which the outlet end of the funnel extends between the side flaps, means connected to said rocker shaft for extending and retracting said product guide funnel in timed relation with reciprocation of the slides, a pusher mounted at the loading station for movement from a retracted position to an extended position and back to push product off the conveyor and through the funnel and into a carton at the loading station, and means for operating said pusher between its retracted and extended position in timed relation with reciprocation of the slides.

19. A multi-lane packaging machine for feeding, erecting, loading and closing cartons of the type having a pair of side panels connected along fold lines to a pair of end panels and side and end flaps on opposite ends of the respective side and end panels, the packaging machine comprising at least two upright carton transfer means disposed alongside each other and each extending from a carton infeed station adjacent their lower end past a carton loading station to a carton discharge station adjacent their upper end, each carton transfer means including a pair of vertically extending lateral carton guides defining a pair of parallel carton guide planes, the carton transfer means each being open along front and rear sides thereof between the pair of guide planes, a plurality of carton supports at spaced locations along each pair of lateral carton guides each adapted to underlie and support a carton after it is advanced therepast, a transfer slide mounted for reciprocation along the carton guides of each pair and having a plurality of pushers at spaced locations therealong operative when the slide is moved upwardly to advance a plurality of cartons upwardly in step fashion, a carton magazine individual to each carton transfer means for storing a stack of flattened blanks with one end adjacent the carton infeed station, carton infeed means individual to each carton transfer means for withdrawing a flattened carton blank from the associated magazine and for erecting and feeding the erected carton to the respective carton transfer means with end panels of the carton disposed alongside the pair of carton guides and the side panels extending horizontally between the pair of carton guides and with the side and end flaps extending through the open front and rear sides of the carton transfer means, drive means for reciprocating the transfer slides in unison, means for operating the carton infeed means in timed relation with the reciprocation of the transfer slides, carton loading means at one open side of each of the carton transfer means for feeding product along a generally horizontally path into a carton at the respective loading station, means intermediate the upper and lower ends of each of the carton guide means for infolding the side and end flaps on the cartons, carton receiving means adjacent the upper ends of the carton guide means, and means adjacent the upper ends of the carton guide means for discharging cartons onto the receiving means.

20. A multi-lane packaging machine according to claim 19 wherein each of the carton feed means includes a feed member, means for oscillating each feed member in a plane that extends between and parallel to the carton guide planes of the associated carton guide means at the carton infeed station, the carton magazines being located at the front sides of the associated carton transfer means and supporting the flattened carton blank at said one end of the stack in a plane perpendicular to the plane of oscillation of the associated feed member, vacuum operated gripper means mounted on each feed member and having a carton engaging face disposed in a plane perpendicular to the plane of oscillation of the associated feed member, the vacuum operated gripper means being movable with the feed member between a carton pick-up position with its carton engaging face parallel to and engaging the carton blank at said one end of the stack in the associated magazine and a carton delivery position intermediate the carton guides of the associated guide means with the carton engaging face disposed upwardly.

21. A multi-lane machine according to claim 20 wherein said drive means includes a crank individual to each carton transfer means, a link means connecting each crank to a respective pair of slides for reciprocating the slides in response to rotation of the crank shaft, said means for oscillating the feed member including a bar rotatably connected at one end to each crank and pivotally connected intermediate its ends to a respective one of the feed members to oscillate the feed members in timed relation with the reciprocation of the slides.

22. A packaging machine according to claim 19 wherein said means for loading product includes an endless type conveyor means for advancing product to the loading station, a product guide funnel individual to each carton transfer means and having an inlet and an outlet end, means mounting the product guide funnel at the loading station for reciprocation along a generally horizontal path toward and away from a respective one of the transfer means between a retracted position in which the outlet end of the funnel is spaced outwardly from the side flaps on the adjacent end of the carton and an extended position in which the outlet end of the funnel extends between the side flaps, means for extending and retracting said product guide funnel in timed relation with reciprocation of the slides, a product pusher individual to each transfer means mounted for movement from a retracted position to an extended position and back to push product through the funnel and into a carton at the loading station, and means for operating the pushers in timed relation with reciprocation of the slides.

23. A packaging machine according to claim 19 wherein said means for infolding the flaps includes front and rear flap folding mechanisms respectively adjacent the front and rear sides of each of the carton transfer means at a front and rear flap folding locations, each flap folding mechanism including a pair of arms mounted for movement toward and away from each other, said arms each having end flap folding fingers arranged to engage and infold end flaps on a respective end of the carton when the arms are moved toward each other to an end flap folding position, the arms having a second finger arranged to overlie the upper one of the side panels at a respective end of the carton when the arms are in said end flap folding position to restrain upward movement of the end of the carton, a side flap folding means mounted for movement through a flap folding cycle to engage and fold the side flaps on one end of the side panels upwardly, and means for operating said flap folding mechanism in timed relation with the reciprocation of the slides.

24. A packaging machine according to claim 19 including horizontal front and rear rotary shafts respectively adjacent the front and rear sides of the carton transfer means at front and rear flap folding stations, horizontal front and rear rocker shafts respectively adjacent the front and rear sides of the carton transfer means at the front and rear flap folding stations, front and rear end flap folding mechanism individual to each carton transfer means, each end flap folding mechanism including a pair of arms mounted for movement toward and away from each other, said arms each having end flap folding fingers arranged to engage and infold end flaps on a respective end of the carton when the arms are moved toward each other to an end flap folding position, the arms having a second finger arranged to overlie the upper one of the side panels at a respective end of the carton when the arms are in said end flap folding position to restrain upward movement of the end of the carton, means including links connecting the front rocker shaft to the pairs of arms of each of the front end flap folding mechanisms to operate the front end flap folding mechanisms in response to angular oscillation of the front rocker shaft, means including links connecting the rear rocker shaft to the pairs of arms of each of the rear end flap folding mechanisms to operate the rear end flap folding mechanisms in response to angular oscillation of the rear rocker shaft, means for angularly oscillating said front and rear rocker shafts in timed relation with the reciprocation of the slides, front and rear side flap folding mechanisms individual to each carton transfer means, each front side flap folding mechanism including at least one side flap folding cam mounted on the front rotary shaft for rotation therewith in a generally upright path intermediate the associated end flap folding fingers, each rear side flap folding mechanism including at least one side flap folding cam mounted on the rear rotary shaft for rotation therewith in a generally upright path, and means for rotating said front and rear rotary shafts in timed relation with the reciprocation of the slides.

25. A packaging machine according to claim 24 including front and rear adhesive applicator nozzles individual to each transfer means mounted for reciprocating movement along a horizontal path at front and rear adhesive applying locations above the respective front and rear flap folding locations to apply a band of adhesive to one of the upwardly folded side flaps, means for reciprocating the nozzles in timed relation with the reciprocation of the slides, and front and rear lead flap folding means individual to each transfer means and engageable with the side flap on the upper side panel for folding it downwardly as the cartons are advanced upwardly away from the respective front and rear adhesive applying location.

26. A packaging machine according to claim 24 wherein said means for loading product includes conveyor means for advancing product to the loading station, a product guide funnel individual to each transfer means having an inlet and an outlet end, means mounting the product guide funnel at the loading station for reciprocation along a generally horizontal path toward and away from the respective transfer means between a retracted position in which the outlet end of the funnel is spaced outwardly from the side flaps on the adjacent end of the carton and an extended position in which the outlet end of the funnel extends between the side flaps, means connected to said rocker shaft for extending and retracting said product guide funnels in timed relation with reciprocation of the slides, a pusher mounted at the loading station for movement from a retracted position to an extended position and back to push product off the conveyor and through the funnel and into a carton at the loading station, and means for operating said pusher between its retracted and extended position in timed relation with reciprocation of the slides.

27. A packaging machine according to claim 19 wherein said carton receiving means includes conveyor means extending alongside the carton transfer means, said means for discharging cartons including a discharge pusher individual to each transfer means and mounted for movement crosswise of the respective transfer means adjacent its upper end, and means for operating said discharge pusher in timed relation with the reciprocation of the transfer means.

28. A packaging machine according to claim 1 wherein said means for infolding the side and end flaps includes first and second end flap folding fingers each supported at one end and extending toward each other, finger mounting means mounting the end flap folding fingers adjacent one open side of the carton transfer means for movement in first relatively opposite directions crosswise of said first open side of the carton transfer means toward and away from each other, said finger mounting means also including means mounting the end flap folding fingers for movement in a second direction transverse to said first directions toward and away from said one open side of the carton transfer means, first finger operating means for moving said end flap folding fingers in said first relatively opposite directions, second finger operating means for moving said end flap folding fingers in said second direction, means for operating said first and second finger operating means in timed relation with each other and with the transfer slides to:

(a) position the end flap folding fingers at respective first positions in which the distal ends of the fingers are spaced apart a distance not less than the spacing between the carton guide planes and are spaced laterally outwardly from said one open side of the carton transfer means;

(b) move the end flap folding fingers from their respective first positions along curved paths simultaneously toward each other and toward the carton transfer means to a respective second position adjacent a plane through said one open side of the carton transfer means to infold the end flaps;

(c) move the end flap folding fingers from their respective second positions in linear paths paralleling a plane through said one open side of the carton transfer means away from each other to a third position in which the distal ends of the flap folding fingers are disposed outwardly of the carton guide planes;

(d) move the end flap folding fingers from their third position back to their first position; said means for infolding the side and end flaps including side flap folding means mounted for movement through a side flap folding cycle to fold one side flap across the end of the carton, and means for operating said side flap folding means to fold said one side flap across the end of the carton while the end flap folding fingers are disposed adjacent a plane through the open side of the transfer means.

29. A packaging machine according to claim 28 wherein said side flap folding means includes first and second side flap folding cams mounted for movement in planes generally paralleling the first and second guide planes.

30. A packaging machine according to claim 28 wherein said side flap folding means includes first and second side flap folding cams mounted for movement in planes generally paralleling said first and second guide planes and crosswise of the respective first and second end flap folding fingers when they are in their second positions.

31. A packaging machine for feeding, erecting, loading and closing cartons of the type having a pair of side panels connected along fold lines to a pair of end panels and side and end flaps on opposite ends of the respective side and end panels, the packaging machine comprising: carton transfer means extending from a carton infeed station adjacent one end past a carton loading station to a carton discharge station adjacent the other end of the carton transfer means, the carton transfer means including a first and second lateral carton guides defining first and second parallel carton guide planes, the carton transfer means being open along opposite sides thereof between the first and second guide planes, a plurality of carton stops at spaced locations along the first and second lateral carton guides each adapted to engage and support a carton after it is advanced therepast, a transfer slide mounted for reciprocation along each carton guide and having a plurality of pushers at spaced locations along the slides operative when the slide is moved in a forward direction to advance a plurality of cartons forwardly in step fashion, a carton magazine for storing a stack of flattened carton blanks with one end of the stack adjacent the carton infeed station, carton infeed means for withdrawing a flattened carton blank from said one end of the stack and for erecting and feeding the erected carton to the carton guides with the end panels of the carton disposed alongside the carton guides and side panels extending between the guides and with the side and end flaps extending through the open sides of the carton transfer means, drive means for reciprocating the transfer slides, means for operating the carton infeed means in timed relation with the reciprocation of the transfer slides, carton loading means for feeding product into a carton at the loading station, flap folding means intermediate the ends of the carton transfer means for infolding the side and end flaps on at least one end of the cartons, said flap folding means including first and second end flap folding fingers each supported at one end and extending toward each other at the other ends, finger mounting means mounting the end flap folding fingers adjacent one open side of the carton transfer means for movement in first relatively opposite directions crosswise of said one open side of the carton transfer means toward and away from each other, said finger mounting means including means mounting said first and second fingers for movement in a second direction transverse to said first directions toward and away from said one open side of the carton transfer means, first finger operating means for moving said first and second fingers in said first relatively opposite directions, second finger operating means for moving said first and second fingers in said second direction, means for operating said first and second finger operating means in timed relation with each other and with the transfer slides to:

(a) position the first and second fingers at respective first positions in which the distal ends of the fingers are spaced apart a distance not less than the spacing between the carton guide planes and are spaced laterally outwardly from said one open side of the carton transfer means;

(b) move the first and second end flap folding fingers from their respective first positions along first and second curved paths extending toward each other and toward the carton transfer means to a respective second position adjacent a plane through said one open side of the carton transfer means to infold the first and second end flaps;

(c) move the first and second end flap folding fingers from their respective second positions in generally linear paths paralleling a plane through said one open side of the carton transfer means away from each other to a third position in which the distal ends of the first and second flap folding fingers are disposed outwardly of the respective first and second carton guide planes;

(d) move the first and second end flap folding fingers from their third position back to their first position;

said flap folding means including side flap folding means mounted for movement through a side flap folding cycle to fold one side flap across the end of the carton, and means for operating said side flap folding means to fold said one side flap across the end of the carton before the end flap folding fingers move from their second to their third positions.

32. A packaging machine according to claim 31 wherein said side flap folding means includes first and second side flap folding cams mounted for movement in planes generally paralleling the first and second guide planes.

33. A packaging machine according to claim 31 wherein said side flap folding means includes first and second side flap folding cams mounted for movement in planes generally paralleling said first and second guide planes and crosswise of the respective first and second end flap folding fingers when they are in their second positions.

34. A packaging machine according to claim 31 wherein said finger mounting means includes first and second elongated cross members mounted for relative lengthwise reciprocation in said first relatively opposite directions, said finger mounting means including means mounting said first and second cross members for angular movement about an axis paralleling their length, and first and second arms attached to the respective first and second cross members for movement therewith and respectively supporting said first and second end flap folding fingers.

35. A packaging machine according to claim 34 wherein said side flap folding means includes at least one side flap folding cam mounted on a cross shaft for rotation in a plane between and generally parallel to the first and second guide planes, said second finger operating means including a cam on said cross shaft and a follower engaging said cam.

36. A packaging machine according to claim 35 wherein said first finger operating means includes a rocker shaft paralleling said cross shaft and angularly oscillated in timed relation with the reciprocation of said transfer slides, and means operatively connecting said rocker shaft to said first and second cross members.

* * * * *

UNITED STATES PATENT AND TRADEMARK OFFICE

CERTIFICATE OF CORRECTION

PATENT NO. : 4,545,183

DATED : October 8, 1985

INVENTOR(S) : Roger H. Stohlquist et al

It is certified that error appears in the above-identified patent and that said Letters Patent are hereby corrected as shown below:

Claim 1, column 17, line 22, "and" should be -- end --.

Signed and Sealed this

*Twenty-fourth* Day of *December 1985*

[SEAL]

*Attest:*

DONALD J. QUIGG

*Attesting Officer*

*Commissioner of Patents and Trademarks*